US010539921B1

(12) United States Patent
Yamashita

(10) Patent No.: US 10,539,921 B1
(45) Date of Patent: Jan. 21, 2020

(54) SUPPORT FOR ELECTROPHOTOGRAPHIC PHOTORECEPTOR, ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventor: Takayuki Yamashita, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/258,692

(22) Filed: Jan. 28, 2019

(30) Foreign Application Priority Data

Sep. 21, 2018 (JP) ..... 2018-176966

(51) Int. Cl.
*G03G 21/16* (2006.01)
*G03G 21/18* (2006.01)
*G03G 15/00* (2006.01)

(52) U.S. Cl.
CPC ..... *G03G 21/1647* (2013.01); *G03G 15/75* (2013.01); *G03G 21/1671* (2013.01); *G03G 21/1803* (2013.01)

(58) Field of Classification Search
None
See application file for complete search history.

(56) References Cited

U.S. PATENT DOCUMENTS 5,080,993 A * 1/1992 Maruta ..... G03G 5/08207 427/292
5,223,363 A * 6/1993 Shozi ..... G03G 5/10 430/127
6,139,998 A * 10/2000 Mochizuki ..... G03G 5/10 430/56
2004/0053151 A1* 3/2004 Hashimoto ..... G03G 5/10 430/69
2010/0330475 A1* 12/2010 Tamoto ..... G03G 5/0614 430/56
2012/0321348 A1* 12/2012 Toriu ..... G03G 15/751 399/159
2014/0363193 A1* 12/2014 Wayman ..... G03G 21/0052 399/98

FOREIGN PATENT DOCUMENTS

JP 2008-176055 7/2008
JP 2011075621 A * 4/2011
JP 2011227177 A * 11/2011
JP 2013-205479 10/2013

* cited by examiner

*Primary Examiner* — Sevan A Aydin
(74) *Attorney, Agent, or Firm* — JCIPRNET

(57) ABSTRACT

A support for an electrophotographic photoreceptor includes a cylindrical cut pipe having a cut surface as the outer peripheral surface. The outer peripheral surface has an arithmetic average waviness Wa of 0.15 μm or less in the axial direction and a peak count PPc of 100 or more and 990 or less in the axial direction.

20 Claims, 6 Drawing Sheets

SUPPORT FOR ELECTROPHOTOGRAPHIC PHOTORECEPTOR, ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2018-176966 filed Sep. 21, 2018.

BACKGROUND

(i) Technical Field

The present disclosure relates to a support for an electrophotographic photoreceptor, an electrophotographic photoreceptor, a process cartridge, and an image forming apparatus.

(ii) Related Art

Japanese Unexamined Patent Application Publication No. 2008-176055 discloses a laminated organic electrophotographic photoreceptor including a conductive support which has a surface satisfying the conditions of a maximum height (Ry) of 0.8 to 1.4 μm, an average peak interval (Sm) of 5 to 30 μm, a center average roughness (Ra) of 0.10 to 0.15 m, a ten-point average roughness (Rz) of 0.7 to 1.3 μm, and a peak count (Pc (−0.2 to 0.2 μm)) of 60 to 100. In the uppermost surface layer of the photoreceptor, inorganic particles having an average particle diameter of 1 nm or more and 300 nm or less are uniformly dispersed in a state satisfying a specific relational expression.

Japanese Unexamined Patent Application Publication No. 2013-205479 discloses an electrophotographic photoreceptor including a cylindrical support and a photosensitive layer provided on the support. In measurement of the outer peripheral surface of the support with a measurement length of 6.0 mm in the axial direction by using a stylus-type surface roughness meter, among the recesses present on a roughness curve, the number of recesses having an opening distance of 30 μm or more and less than 250 μm and a depth of 1 μm or more and less than 5 μm is 10 or more and 100 or less, the number of recesses having an opening distance of 25 μm or more and less than 400 μm and a depth of less than 8 μm is 5 or less, the number of recesses having an opening distance of less than 400 μm and a depth of 5 μm or more and less than 8 μm is 5 or less, and the number of recesses having an opening distance of 400 μm or more or a depth of 8 μm or more is 0.

SUMMARY

For example, a cut pipe produced by cutting the outer peripheral surface of an element pipe is used as a support for an electrophotographic photoreceptor. The cut pipe is processed while being rotated by, for example, a NC (Numerically Control) lathe or the like in the process of forming a cut surface on the outer peripheral surface by cutting. Therefore, helical cutting marks may remain as waviness in the axial direction on the outer peripheral surface. When the cut pipe having waviness in the axial direction on the outer peripheral surface is used as a support for an electrophotographic photoreceptor, striped density unevenness corresponding to the waviness may occur in the obtained image.

Aspects of non-limiting embodiments of the present disclosure relate to a support for an electrophotographic photoreceptor, the support including a cylindrical cut pipe having a cut surface as the outer peripheral surface. The outer peripheral surface has an arithmetic average waviness Wa of 0.15 μm or less in the axial direction and a peak count PPc of 100 or more and 990 or less in the axial direction.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the disclosure, there is provided a support for an electrophotographic photoreceptor, the support including a cylindrical cut pipe having a cut surface as the outer peripheral surface. The outer peripheral surface has an arithmetic average waviness Wa of 0.15 μm or less in the axial direction and a peak count PPc of 100 or more and 990 or less in the axial direction.

BRIEF DESCRIPTION OF THE DRAWINGS

Exemplary embodiments of the present disclosure will be described in detail based on the following figures, wherein.

DETAILED DESCRIPTION

Figure 1:
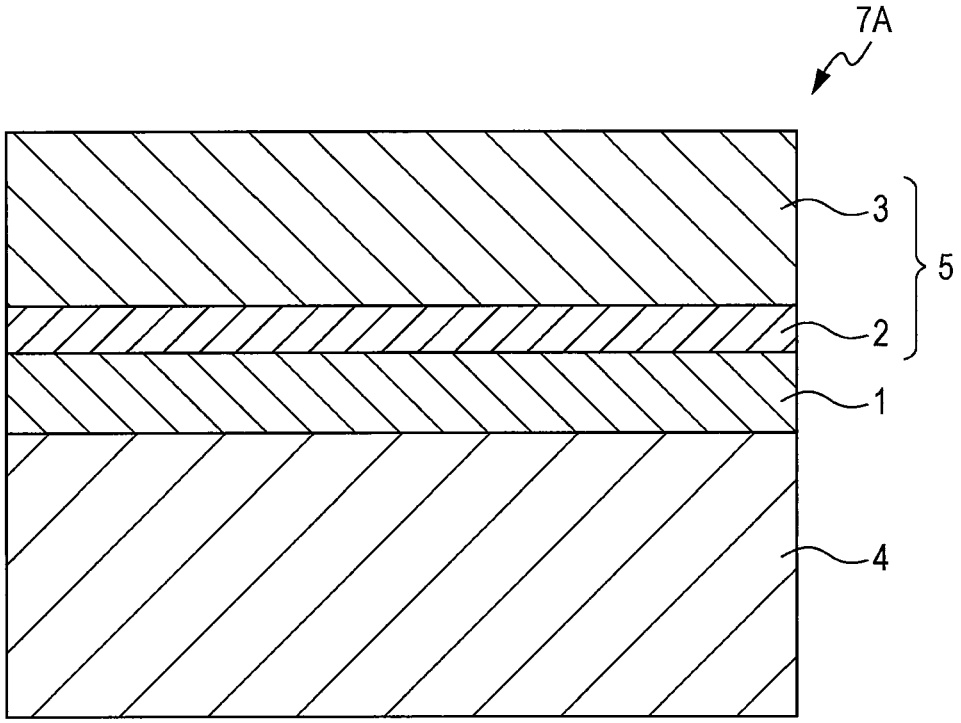
FIG. 1 is a schematic partial sectional view showing an example of the configuration of a photoreceptor according to an exemplary embodiment of the present disclosure.

Exemplary embodiments of the present disclosure are described below.

[Support for Electrophotographic Photoreceptor]

First Exemplary Embodiment

A support for an electrophotographic photoreceptor (hereinafter may be referred to as a "support") according to a first exemplary embodiment of the present disclosure includes a cylindrical cut pipe having a cut surface as the outer peripheral surface. The outer peripheral surface has an arithmetic average waviness Wa of 0.15 μm or less in the axial direction and a peak count PPc of 100 or more and 990 or less in the axial direction. The support according to the first exemplary embodiment having the configuration described above can provide an electrophotographic photoreceptor capable of forming an image with suppressed striped density unevenness.

The cut pipe having a cut surface as the outer peripheral surface is provided with the peripheral surface formed by cutting. In the process of forming the outer peripheral surface by cutting, the pipe is processed while being rotated by, for example, a NC lathe or the like, and thus helical cutting marks may remain as waviness in the axial direction on the outer peripheral surface. When the cut pipe having the waviness in the axial direction on the peripheral surface is used as a support for an electrophotographic photoreceptor, striped density unevenness corresponding to the waviness may occur in the obtained image. In particular, in an image formed by using a developer containing micronized toner particles, graininess easily deteriorates due to the occurrence of striped density unevenness, thereby easily causing rough image quality.

The density unevenness is considered to be caused by the phenomenon that the thickness of a photosensitive layer formed on the photoreceptor periodically varies in the axial direction of the support, thereby creating a state where the electric field applied also periodically varies in the axial direction. Specifically, it is supposed that the density of an image corresponding to a relatively thin region of the photosensitive layer is increased, and thus periodic density variation occurs in the axial direction of the support, thereby forming an image having striped density unevenness.

On the other hand, in the first exemplary embodiment, the outer peripheral surface has an arithmetic average waviness Wa of 0.15 μm or less in the axial direction and a peak count PPc of 100 or more and 990 or less in the axial direction. That is, in the first exemplary embodiment, while the height of waviness on the peripheral surface of the support is decreased, the number of fine projections per unit length is rather increased than usual. As a result, even when the support has the roughed outer peripheral surface, periodic variation in thickness of the photosensitive layer provided on the outer peripheral surface of the support is decreased. It is thus supposed that a density difference due to variation in the thickness is apparently hardly recognized, and thus striped density unevenness is suppressed, thereby suppressing the deterioration in graininess due to density unevenness.

Therefore, the first exemplary embodiment need not use a processing method for decreasing the surface roughness of the outer peripheral surface of the support and thus can provide, at low cost and high productivity, the support which produces an electrophotographic photoreceptor suppressing striped density unevenness.

The arithmetic average waviness Wa is the average absolute value of heights of a waviness curve with a reference length specified in JIS B0601 (2013), and the value is measured by a surface roughness tester (Surfcom 1400, manufactured by Tokyo Seimitsu Co., Ltd.).

Also, the peak count PPc is the "number of peak counted based on cross-sectional curve elements" specified in JIS B0601 (2013) and is the number of peaks contained in a length L (L: 4 mm) of a cross-sectional curve measured by a surface roughness tester (Surfcom 1400, manufactured by Tokyo Seimitsu Co., Ltd.).

The arithmetic average waviness Wa and the peak count PPc are measured as follows.

The surface shape (cross-sectional curve) in the axial direction of the support is measured by scanning the outer peripheral surface from one of the ends to the other end in the axial direction. Scanning in the axial direction is performed a total of 36 times at intervals of 10° in the circumferential direction.

The measurement is performed by using a surface roughness tester (Surfcom 1400, manufactured by Tokyo Seimitsu Co., Ltd.) under the conditions including a measurement length of 4 mm, a cutoff wavelength Xc of 0.8 mm, and a measurement speed of 0.60 mm/s.

The arithmetic average waviness Wa and the peak count PPc are calculated based on the cross-sectional curve obtained by the scanning.

In measuring the support having a layer, such as the photosensitive layer or the like, formed on at least a portion of the outer peripheral surface, for example, the measurement may be performed after the layer is removed.

In the first exemplary embodiment, a method for adjusting, within the respective ranges described above, the arithmetic average waviness Wa and the peak count PPc in the axial direction on the outer peripheral surface of the support is not particularly limited and is, for example, a method of cutting the outer peripheral surface of the support by using a cutting cool having a curved edge as a cutting tool (that is, a blade) with the curved surface of the cutting tool in contact with the outer peripheral surface of the support.

Second Exemplary Embodiment

A support for an electrophotographic photoreceptor (hereinafter may be referred to as a "support") according to a second exemplary embodiment of the present disclosure includes a cylindrical support having periodic waviness in the axial direction on the outer peripheral surface. The outer peripheral surface has an arithmetic average waviness Wa of 0.15 μm or less in the axial direction and a peak count PPc of 100 or more and 990 or less in the axial direction.

The support according to the second exemplary embodiment having the configuration described above can produce an electrophotographic photoreceptor capable of forming an image with suppressed striped density unevenness.

The description "having periodic waviness in the axial direction on the outer peripheral surface" represents that the arithmetic average waviness Wa in the axial direction on the outer peripheral surface is 0.15 μm or more.

The cylindrical support having periodic waviness in the axial direction on the outer peripheral surface is, for example, a cylindrical cut pipe having a cut surface as the outer peripheral surface.

When the cylindrical support having periodic waviness in the axial direction on the peripheral surface is used as a support for an electrophotographic photoreceptor, striped density unevenness corresponding to the waviness may occur in the obtained image. The occurrence mechanism of the density unevenness is as described above.

In addition, in the second exemplary embodiment, the outer peripheral surface of the support has an arithmetic average waviness Wa of 0.15 μm or less in the axial direction and a peak count PPc of 100 or more and 990 or less in the axial direction. That is, in the second exemplary embodiment, the outer peripheral surface of the support has periodic waviness in the axial direction, while the height of waviness is decreased, and the number of fine projections per unit length is rather increased than usual. As a result, even when the support has the roughed peripheral surface, periodic variation in thickness of the photosensitive layer provided on the peripheral surface of the support is decreased. It is thus supposed that a density difference due to variation in the thickness is apparently hardly recognized, and thus striped density unevenness is suppressed.

The definitions and measurement methods for the arithmetic average waviness Wa and the peak count PPc are as described above.

In the second exemplary embodiment, a method for adjusting. Within the respective ranges described above, the arithmetic average waviness Wa and the peak count PPc in the axial direction on the outer peripheral surface of the support is not particularly limited and is, for example, a method of cutting the outer peripheral surface of the support by using a cutting cool having a curved chip as a cutting tool (that is, an edge) with the curved surface of the cutting tool in contact with the outer peripheral surface of the support.

Hereinafter, the first exemplary embodiment and the second exemplary embodiment may be referred to as the "exemplary embodiment of the present disclosure" as a generic name, The support according to the exemplary embodiment of the present disclosure is described in detail below.

<Support>

The material constituting the support is, for example, a metal, and examples thereof include pure metals such as aluminum, iron, copper, and the like, and alloys such as stainless steel, aluminum alloys, and the like.

From the viewpoint of lightness and excellent processability, the metal constituting the support is preferably a metal containing aluminum, and more preferably pure aluminum or an aluminum alloy. The aluminum alloy is not particularly limited as long as it is an alloy containing aluminum as a principal component. For example, an aluminum alloy containing Si, Fe, Cu, Mn, Mg, Cr, Zn, Ti, or the like other than aluminum can be used. The term "principal component" represents the element at the highest content (by weight) among the elements contained in an alloy.

The shape of the support is not particularly limited as long as it is a cylindrical shape.

The thickness (wall thickness) of the support is, for example, 0.2 mm or more and 1.5 mm or less and preferably 0.9 mm or more and 1.5 mm or less.

The diameter and axial direction length of the support are not particularly limited and are values varying with applications and the like. The diameter of the support is, for example, within a range of 20 mm or more and 90 mm or less, and the axial direction length of the support is, for example, within a range of 215 mm or more and 400 mm or less.

The arithmetic waviness Wa in the axial direction on the outer peripheral surface is 0.15 μm or less, preferably 0.01 μm or more and 0.13 μm or less, and more preferably 0.02 μm or more and 0.075 μm or less.

The peak count PPc in the axial direction of the outer peripheral surface is 100 or more and 990 or less, preferably 130 or more and 960 or less, and more preferably 165 or more and 900 or less.

The maximum height Pz in the axial direction on the outer peripheral surface is preferably 0.4 μm or more, more preferably 0.5 μm or more, and still more preferably 0.5 μm or more and 2.0 μm or less.

In the exemplary embodiment of the present disclosure, even when the maximum height Pz in the axial direction on the outer peripheral surface is within the range described above, the arithmetic average waviness Wa and the peak count PPc in the axial direction on the outer peripheral surface are within the respective ranges described above, and thus an electrophotographic photoreceptor which suppresses striped density unevenness can be produced.

The maximum height Pz is the "maximum height Pz of cross-sectional curve" specified in JIS B0601 (2013) and is the value measured by a surface roughness tester (Surfcom 1400, manufactured by Tokyo Seimitsu Co., Ltd.). The method for measuring the maximum height Pz is the same as that for measuring the arithmetic average waviness Wa and the peak count PPc.

The support is preferably a conductive support. The term "conductive" represents that the volume resistivity is less than $10^{13}$ Ωcm.

<Method for Producing Support>

An example of a method for producing the support is described.

First, a solid of an aluminum alloy (JIS A6063 alloy) is extruded by, for example, using an extruder, and the aluminum ally extruded by the extruder is drawn by using a drawing device to form an element pipe.

Next, in a state where the element pipe is held by a holding jig in contact with the inner peripheral surface of the element pipe at both ends in the axial direction, the outer peripheral surface of the element pipe is cut from one of the ends to the other end in the axial direction while the element pipe is rotated together with the holding jig around the axis line. Thus, the support is produced.

If required, the inner peripheral surface may be cut by spigot processing (boring cutting) at both ends of the element pipe before or after cutting the outer peripheral surface. Specifically, for example, cutting the inner peripheral surface of the element pipe is started from one of the ends by using a cutting tool while rotating the element pipe around the axis line of the element pipe, and the inner peripheral surface is cut by moving the cutting tool inward in the axial direction.

Figure 6:
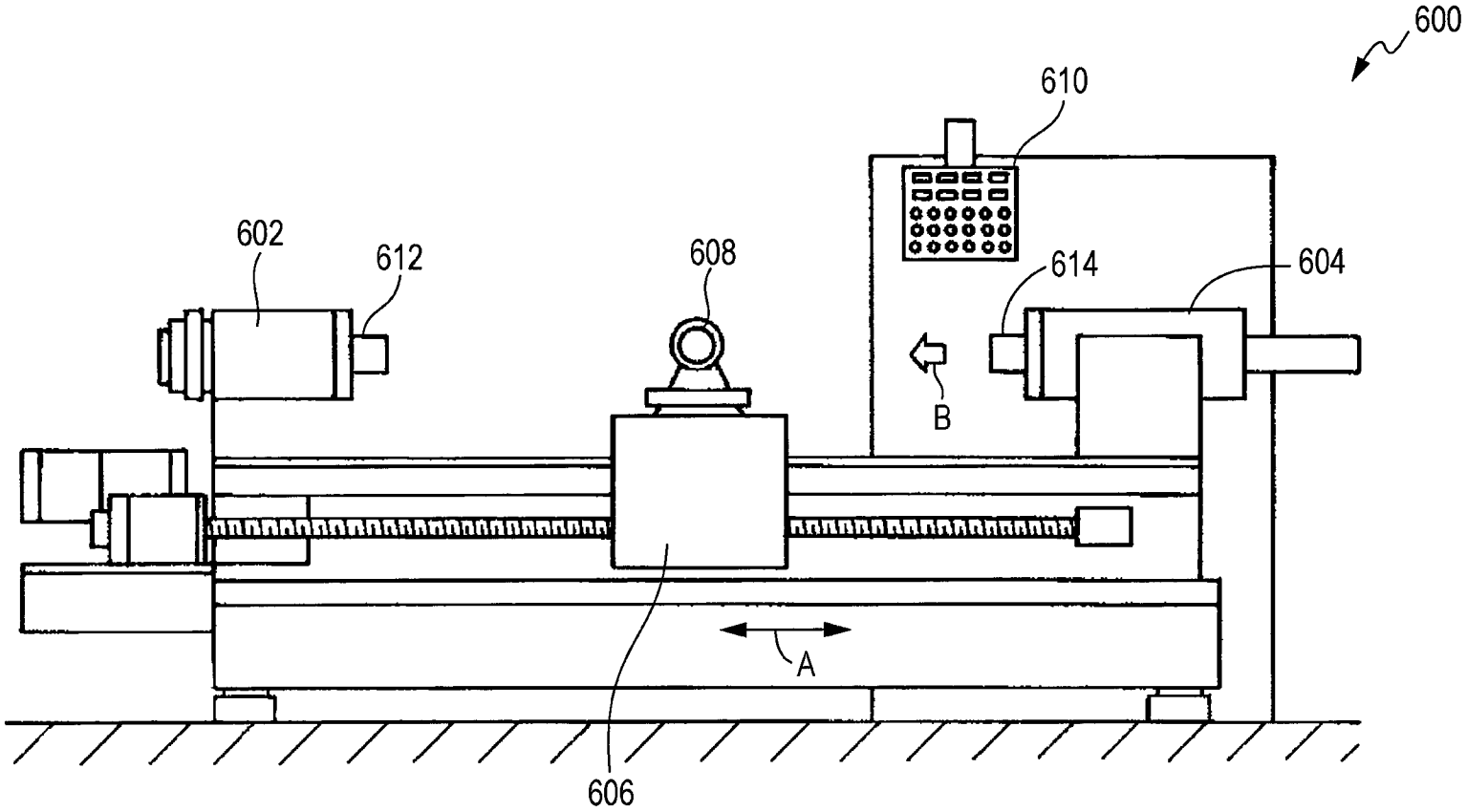
FIG. 6 is a schematic configuration diagram showing an example of a lathe for processing a substrate.

An example of an apparatus for cutting the outer peripheral surface of the element pipe is a lathe for processing substrates or the like. FIG. 6 shows an example of a lathe for processing substrates.

In a lathe 600 shown in FIG. 6, reference numeral 602 denotes a principal axis, reference numeral 604 denotes a tail, reference numeral 608 denotes a lathe turning blade mounted on a tool rest 606, and reference numeral 610 denotes a control panel. In addition, a principal axis-side press member 612 and a tail-side press member 614 are disposed on the principal axis 602 and the tail 604, respectively.

The thin wall pipe is held in the state of being held between the principal axis 602 and the tail 604 and is rotated at a high speed by principal axis driving around the axis of the pipe as a center. The surface is turned by moving, in the longitudinal direction (direction of arrow A) of the thin wall pipe, the lathe turning blade 608, which uses a single crystal or polycrystalline diamond cutting tool, in contact with the surface of the thin wall pipe.

A method for holding the thin wall pipe between the principal axis 602 and the tail 604 is, for example, the following method. Specifically, a member including a vibration-proof material through which a shaft made of a metal or the like is passed is passed through a cylindrical workpiece, and one of the ends of the shaft is engaged with the principal axis-side press member 612. The tail 604 is moved to the principal axis 602 side (arrow B side) by button operation of the control panel 610, and the cylindrical work piece is held by the generated pressure. As a result, the other end is tightly engaged with the tail-side press member 614, thereby holding the cylindrical work piece between the principal axis 602 and the tail 604.

[Electrophotographic Photoreceptor]

An electrophotographic photoreceptor according to an exemplary embodiment of the present disclosure includes a conductive support which is the support according to the exemplary embodiment described above, and a photosensitive layer provided on the conductive support.

FIG. 1 is a schematic sectional view showing an example of the layer configuration of an electrophotographic photoreceptor 7A. The electrophotographic photoreceptor 7A shown in FIG. 1 has a structure in which an under coat layer 1, a charge generation layer 2, and a charge transport layer 3 are laminated in that order on the conductive support 4, and the charge generation layer 2 and the charge transport layer 3 constitute a photosensitive layer 5.

Figure 2:
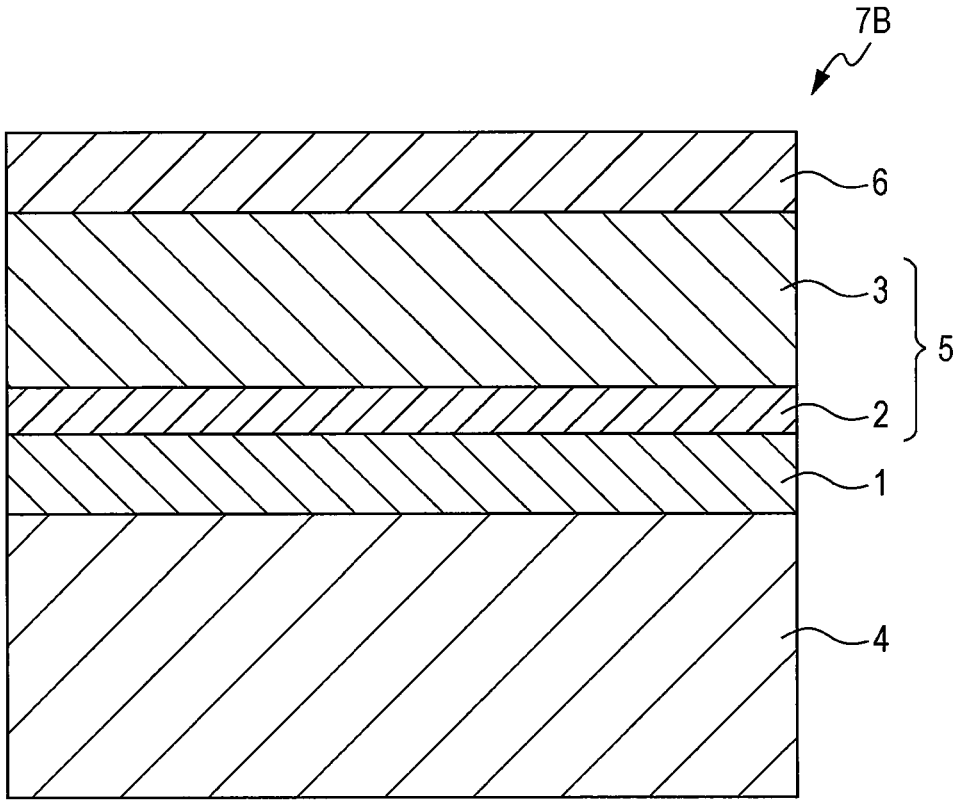
FIG. 2 is a schematic partial sectional view showing another example of the configuration of a photoreceptor according to an exemplary embodiment of the present disclosure.
Figure 3:
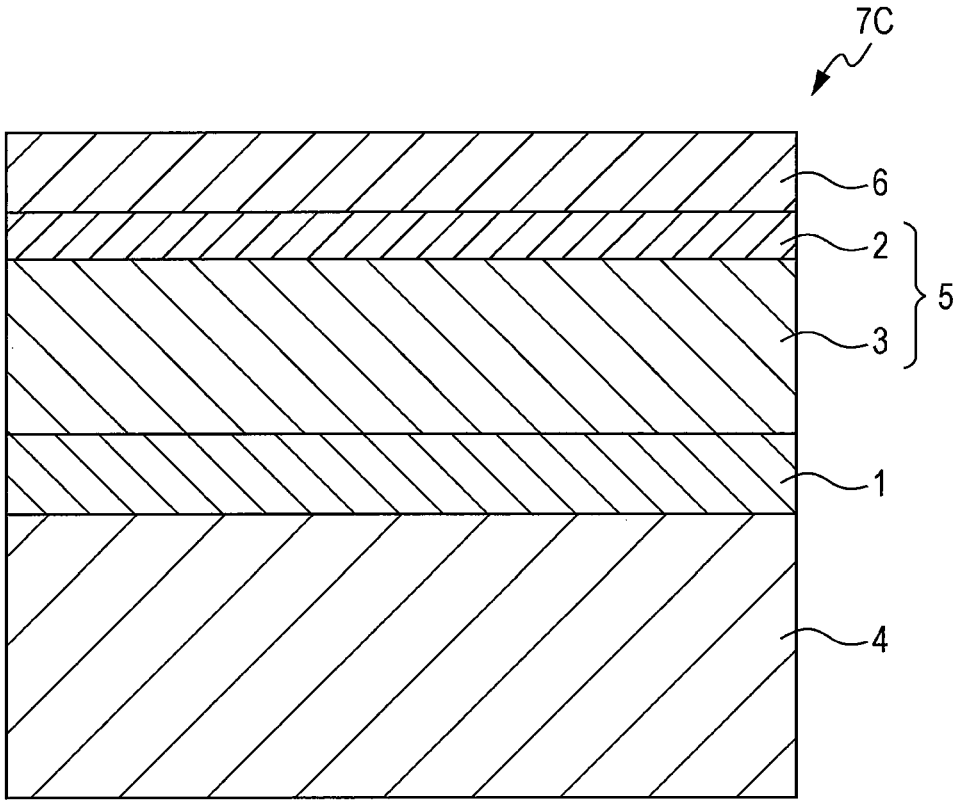
FIG. 3 is a schematic partial sectional view showing a further example of the configuration of a photoreceptor according to an exemplary embodiment of the present disclosure.

FIG. 2 and FIG. 3 are schematic sectional views each showing another example of the layer configuration of the electrophotographic photoreceptor according to the example embodiment.

Like the electrophotographic photoreceptor 7A shown in FIG. 1, each of the electrophotographic photoreceptors 7B and 7C shown in FIG. 2 and FIG. 3, respectively, includes a photosensitive layer 5 having a function divided into a charge generation layer 2 and a charge transport layer 3, and a protective layer 6 formed as an outermost layer. The electrophotographic photoreceptor 7B shown in FIG. 2 has a structure in which the under coat layer 1, the charge generation layer 2, the charge transport layer 3, and the protective layer 6 are laminated in that order on a conductive support 4. The electrophotographic photoreceptor 7C shown in FIG. 3 has a structure in which the under coat layer 1, the charge transport layer 3, the charge generation layer 2, and the protective layer 6 are laminated in that order on a conductive support 4, Each of the electrophotographic photoreceptors 7A and 7C may not be necessarily provided with the undercoat layer 1. Each of the electrophotographic photoreceptors 7A and 7C may include a single-layer type photosensitive layer in which the functions of the charge generation layer 2 and the charge transport layer 3 are integrated.

From the viewpoint of suppressing striped density unevenness, the arithmetic average roughness Ra in the axial direction of the outer peripheral surface of the electrophotographic photoreceptor according to the exemplary embodiment is preferably 0.08 μm or less, more preferably 0.02 μm or more and 0.07 μm or less, and still more preferably 0.04 μm or more and 0.06 μm or less.

The arithmetic average roughness Ra is the absolute average value of heights of a roughness curve with a reference length specified in JIS B0601 (2013), and the value is measured by a surface roughness tester (Surfcom 1400, manufactured by Tokyo Seimitsu Co., Ltd.). The method for measuring the arithmetic average roughness Ra is the same as that for measuring the arithmetic average waviness Wa and the peak count PPc of the outer peripheral surface of the support.

Each of the layers of the electrophotographic photoreceptor is described in detail below. In the description below, reference numerals are omitted.

(Undercoat layer)

The undercoat layer is, for example, a layer containing inorganic particles and a binder resin.

The inorganic particles are, for example, inorganic particles having a powder resistance (volume resistivity) of $10^2$ Ωcm or more and $10^{11}$ Ωcm or less.

Among these inorganic particles, the inorganic particles having the resistance value described above are, for example, preferably metal oxide particles such as tin oxide particles, titanium oxide particles, zinc oxide particles, zirconium oxide particles, or the like, and particularly preferably zinc oxide particles.

The BET method specific surface area of the inorganic particles is, for example, preferably 10 $m^2/g$ or more.

The volume average particle diameter of the inorganic particles is, for example, 50 nm or more and 2000 nm or less (preferably 60 nm or more and 1000 nm or less).

The content of the inorganic particles relative to the binder resin is, for example, preferably 10% by weight or more and 80% by weight or less and more preferably 40% by weight or more and 80% by weight or less.

The inorganic particles may be surface-treated. A mixture of two or more types having different surface treatments or different particle diameters may be used as the inorganic particles.

Examples of a surface treatment agent include a silane coupling agent, a titanate-based coupling agent, an aluminum-based coupling agent, a surfactant, and the like. The silane coupling agent is particularly preferred, and the silane coupling agent more preferably has an amino group.

Examples of the silane coupling agent having an amino group include, but are not limited to, 3-aminopropyl triethoxysilane, N-2-(aminoethyl)-3-aminopropyl trimethoxysilane, N-2-(aminoethyl)-3-aminopropyl methyldimethoxysilane, N,N-bis(2-hydroxyethyl)-3-aminopropyl triethoxysilane, and the like.

A mixture of two or more silane coupling agents may be used. For example, the silane coupling agent having an amino group may be used in combination with another silane coupling agent. Examples of the other silane coupling agent include, but are not limited to, vinyltrimethoxysilane, 3-methacryloxypropyl-tris(2-methoxyethoxy)silane, 2-(3,4-epoxycyclohexyl)ethyl trimethoxysilane, 3-glycidoxypropyl trimethoxysilane, vinyltriacetoxysilane, 3-mercaptopropyl trimethoxysilane, 3-aminopropyl triethoxysilane, N-2-(aminoethyl)-3-aminopropyl trimethoxysilane, N-2-(aminoethyl)-3-aminopropyl methyldimethoxysilane, N,N-bis(2-hydroxyethyl)-3-aminopropyl triethoxysilane, 3-chloropropyl trimethoxysilane, and the like.

A method for surface treatment with the surface treatment agent may be any known method, and either a dry method or a wet method may be used.

The amount of treatment with the surface treatment agent relative to the inorganic particles is, for example, preferably 0.5% by weight or more and 10% by weight or less.

The undercoat layer contains an electron-accepting compound (acceptor compound) together with the inorganic particles from the viewpoint of enhancing the long-term stability of electric characteristics and a carrier blocking property.

Examples of the electron-accepting compound include electron transport materials such as quinone compounds, such as chloranil, bromanil, and the like; tetracyanoquinodimethane compounds; fluorenone compounds, such as 2,4,7-trinitrofluorenone, 2,4,5,7-tetranitro-9-fluorenone, and the like; oxadiazole compounds, such as 2-(4-biphenyl)-5-(4-tert-butylphenyl)-1,3,4-oxadiazole, 2,5-bis(4-naphthyl)-1,3,4-oxadiazole, 2,5-bis(4-diethylaminophenyl)-1,3,4-oxadiazole, and the like; xanthone compounds; thiophene compounds; diphenoquinone compounds, such as 3,3',5,5'-tetra-tert-butyldiphenoquinone and the like; and the like.

A compound having an anthraquinone structure is particularly preferred as the electron-accepting compound. Preferred examples of the compound having an anthraquinone structure include hydroxyanthraquinone compounds, aminoanthraquinone compounds, aminohydroxyanthraquinone compounds, and the like. Specific examples thereof include anthraquinone, alizarin, quinizarin, anthrarufin, purpurin, and the like.

The electron-accepting compound may be contained in a state of being dispersed together with the inorganic particles in the undercoat layer or may be contained in a state of adhering to the surfaces of the inorganic particles.

Examples of a method for adhering the electron-accepting compound to the surfaces of the inorganic particles include a dry method and a wet method.

The dry method is, for example, a method for adhering the electron-accepting compound to the surfaces of the inorganic particles by dropping or spraying, together with dry air or nitrogen gas, the electron-accepting compound directly or in the form of a solution in an organic solvent. The electron-accepting compound is preferably dropped or sprayed at a temperature equivalent to or lower than the boiling point of the solvent. After the electron-accepting compound is dropped or sprayed, baking may be further performed at 100° C. or more. The baking is not particularly limited as long as the temperature and time are determined so as to obtain electrophotographic characteristics.

The wet method is, for example, a method for adhering the electron-accepting compound to the surfaces of the inorganic particles by adding the electron-accepting compound while dispersing the inorganic particles by stirring, ultrasonic waves, a sand mill, an attritor, a ball mill, or the like, stirring or dispersing the resultant mixture, and then removing a solvent. A method for removing the solvent is, for example, filtration or distillation off. After the solvent is removed, baking may be further performed at 100° C. or more. The baking is not particularly limited as long as the temperature and time are determined so as to obtain electrophotographic characteristics. In the wet method, the water contained in the inorganic particles may be removed before the electron-accepting compound is added. For example, a method of removing the water under stirring and heating in the solvent or a method of removing the water by azeotropy with the solvent can be used.

The electron-accepting compound may be adhered before or after surface treatment of the inorganic particles with the surface treatment agent or may be adhered at the same time as surface treatment with the surface treatment agent.

The content of the electron-accepting compound relative to the inorganic particles is, for example, 0.01% by weight or more and 20% by weight or less and preferably 0.01% by weight or more and 10% by weight or less.

Examples of the binder resin used in the undercoat layer include known materials such as known polymer compounds, such as an acetal resin (for example, polyvinyl butyral or the like), a polyvinyl alcohol resin, a polyvinyl acetal resin, a casein resin, a polyamide resin, a cellulose resin, gelatin, a polyurethane resin, a polyester resin, an unsaturated polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a urea resin, a phenol resin, a phenol-formaldehyde resin, a melamine resin, a urethane resin, an alkyd resin, an epoxy resin, and the like; zirconium chelate compounds; titanium chelate compounds; aluminum chelate compounds; titanium alkoxide compounds; organic titanium compounds; silane coupling agents; and the like.

Other examples of the binder resin used in the undercoat layer include charge transport resins having a charge transport group, conductive resins (for example, polyaniline and the like), and the like.

Among these, a resin insoluble in a coating solvent of an upper layer is preferred as the binder resin used in the undercoat layer. Particularly preferred is a resin obtained by reaction at least one resin with a curing agent, the at least one resin being selected from the group including thermosetting resins such as a urea resin, a phenol resin, a phenol-formaldehyde resin, a melamine resin, a urethane resin, an unsaturated polyester resin, an alkyd resin, an epoxy resin, and the like; a polyamide resin; a polyester resin; a polyether resin; a methacrylic resin; an acrylic resin; a polyvinyl alcohol resin; and a polyvinyl acetal resin.

When two or more of these binder resins are used in combination, the mixing ratio is set according to demand.

The undercoat layer may contain various additives for improving electric characteristics, environmental stability, and image quality.

Examples of the additives include known materials such as polycyclic condensed- or azo-electron transport pigments, zirconium chelate compounds, titanium chelate compounds, aluminum chelate compounds, titanium alkoxide compounds, organic titanium compounds, silane coupling agents, and the like. The silane coupling agent is used as the surface treatment agent for the inorganic particles as described above, but may be further added as an additive to the undercoat layer.

Examples of the silane coupling agent as an additive include vinyltrimethoxysilane, 3-methacryloxypropyl-tris(2-methoxyethoxy)silane, 2-(3,4-epoxycyclohexyl)ethyl trimethoxysilane, 3-glycidoxypropyl trimethoxysilane, vinyl triacetoxysilane, 3-mercaptopropyl trimethoxysilane, 3-aminopropyl triethoxysilane, N-2-(aminoethyl)-3-aminopropyl trimethoxysilane, N-2-(aminoethyl)-3-aminopropylmethyl dimethoxysilane, N,N-bis(2-hydroxyethyl)-3-aminopropyl triethoxysilane, 3-chloropropyl trimethoxysilane, and the like.

Examples of the zirconium chelate compounds include zirconium butoxide, zirconium ethyl acetoacetate, zirconium triethanolamine, zirconium acetylacetonate butoxide, zirconium ethyl acetoacetate butoxide, zirconium acetate, zirconium oxalate, zirconium lactate, zirconium phosphonate, zirconium octanoate, zirconium naphthenate, zirconium laurate, zirconium stearate, zirconium isostearate, zirconium methacrylate butoxide, zirconium stearate butoxide, zirconium isostearate butoxide, and the like.

Examples of the titanium chelate compounds include tetraisopropyl titanate, tetra-n-butyl titanate, a butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, titanium triethanolaminate, polyhydroxytitanium stearate, and the like.

Examples of the aluminum chelate compounds include aluminum isopropylate, monobutoxyaluminum diisopropylate, aluminum butyrate, diethylacetoacetate aluminum diisopropylate, aluminum tris(ethylacetoacetate), and the like.

These additives may be used alone or as a mixture or polycondensate of plural compounds.

The undercoat layer preferably has a Vickers hardness of 35 or more.

In order to suppress moire fringes, the surface roughness (ten-point average roughness) of the undercoat layer is preferably adjusted to 1/(4n) (n is the refractive index of an upper layer) to ½ of the wavelength λ of the exposure laser used.

In order to adjust the surface roughness, resin particles or the like may be added to the undercoat layer. Examples of the resin particles include silicone resin particles, cross-linked polymethyl methacrylate resin particles, and the like. In addition, the surface of the undercoat layer may be polished for adjusting the surface roughness. Examples of a polishing method include puff polishing, sand blast polishing, wet honing, grinding, and the like.

A method for forming the undercoat layer is not particularly limited, and a known forming method can be used. For example, a coating film of a coating solution for forming the undercoat layer, which is prepared by adding the components described above to a solvent, is formed, dried, and, if required, heated.

Examples of the solvent for preparing the coating solution for forming the undercoat layer include known organic solvents, such as alcohol solvents, aromatic hydrocarbon solvents, halogenated hydrocarbon solvents, ketone solvents, ketone alcohol solvents, ether solvents, ester solvents, and the like.

Specific examples of the solvents include usual organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, toluene, and the like.

Examples of a method for dispersing the inorganic particles in preparing the coating solution for forming the undercoat layer include known methods such as a roll mill, a ball mill, a vibrating ball mill, an attritor, a sand mill, a colloid mill, a paint shaker, and the like.

Examples of a method for applying the coating solution for forming the undercoat layer to the support include a blade coating method, a wire bar coating method, a spray coating method, a dip coating method, a bead coating method, an air knife coating method, a curtain coating method, and the like.

The thickness of the undercoat layer is, for example, preferably set within a range of 15 μm or more, more preferably 20 μm or more and 50 μm or less.

(Intermediate Layer)

Although not shown in the drawings, an intermediate layer may be further provided between the undercoat layer and the photosensitive layer.

The intermediate layer is, for example, a layer containing a resin. Examples of the resin used in the intermediate layer include polymer compounds such as an acetal resin (for example, polyvinyl butyral or the like), a polyvinyl alcohol resin, a polyvinyl acetal resin, a casein resin, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol-formaldehyde resin, a melamine resin, and the like.

The intermediate layer may be a layer containing an organic metal compound. Examples of the organic metal compound used in the intermediate layer include organic metal compounds each containing a metal atom such as zirconium, titanium, aluminum, manganese, silicon, or the like, and the like.

These compounds used in the intermediate layer may be used alone or as a mixture or polycondensate of plural compounds.

Among these, the intermediate layer is preferably a layer containing an organic metal compound containing a zirconium atom or silicon atom.

A method for forming the intermediate layer is not particularly limited, and a known forming method can be used. For example, a coating film of a coating solution for forming the intermediate layer, which is prepared by adding the components described above to a solvent, is formed, dried, and, if required, heated.

Examples of a coating method for forming the intermediate layer include a dip coating method, a push-up coating method, a wire bar coating method, a spray coating method, a blade coating method, a knife coating method, a curtain coating method, and the like.

The thickness of the intermediate layer is, for example, preferably set within a range of 0.1 μm or more and 3 μm or less. The intermediate layer may be used as the undercoat layer.

(Charge Generation Layer)

The charge generation layer is, for example, a layer containing a charge generation material and a binder resin. The charge generation layer may also be a vapor-deposited layer of the charge generation material. The vapor-deposited layer of the charge generation material is preferred for the use of an incoherence light source such as LED (Light Emitting Diode), an organic EL (Electro-Luminescence) image array, or the like.

Examples of the charge generation material include azo pigments such as bisazo or trisazo pigments, and the like; condensed-ring aromatic pigments such as dibromoanthanthrone and the like; perylene pigments; pyrrolo-pyrrole pigments; phthalocyanine pigments; zinc oxide; trigonal selenium; and the like.

Among these, a metal phthalocyanine pigment or a non-metal phthalocyanine pigment is preferably used as the charge generation material in order to correspond to laser exposure within the near-infrared region. More preferred examples thereof include hydroxyl gallium phthalocyanine, chlorogallium phthalocyanine, dichlorotin phthalocyanine, and titanyl phthalocyanine.

Examples of the charge generation material preferred for coping with laser exposure within the near-ultraviolet region include condensed ring aromatic pigments such as dibromoanthanthrone and the like; thioindigo pigments; porphyrazine compounds; zinc oxide; trigonal selenium; bisazo pigments, and the like.

Even when an incoherence light source such as LED having an emission center wavelength of 450 nm or more and 780 nm or less, an organic EL image array, or the like is used, the charge generation material described above may be used. However, when a thin film of 20 μm or less is used as the photosensitive layer from the viewpoint of resolution, the electric field strength in the photosensitive layer is increased, and charge reduction due to charge injection from a substrate, that is, an image defect referred to as "black spot", easily occurs. This becomes significant when a p-type semiconductor, which easily produces a dark current, such as trigonal selenium, a phthalocyanine pigment, or the like, is used as the charge generation material.

While when a n-type semiconductor such as a condensed-ring aromatic pigment, a perylene pigment, an azo pigment, or the like is used as the charge generation material, little dark current is generated, and thus even with a thin film, an image defect referred to as "black spot" can be suppressed.

In addition, the n-type is determined by the polarity of a flowing photocurrent using a time-of-flight method generally used, and a material which allows electrons to more easily flow than holes as carriers is determined as the n-type.

The binder resin used in the charge generation layer is selected from a wide range of insulating resins, and the binder resin may be selected from organic photoconductive polymers such as poly-N-vinyl carbazole, polyvinyl anthracene, polyvinyl pyrene, polysilane, and the like.

Examples of the binder resin include a polyvinyl butyral resin, a polyarylate resin (a polycondensate of bisphenol and a divalent aromatic carboxylic acid or the like), a polycarbonate resin, a polyester resin, a phenoxy resin, a vinyl chloride-vinyl acetate copolymer, a polyamide resin, an acrylic resin, a polyacrylamide resin, a polyvinylpyridine resin, a cellulose resin, a urethane resin, an epoxy resin, casein, a polyvinyl alcohol resin, a polyvinyl pyrrolidone resin, and the like. The term "insulating" represents that the volume resistivity is $10^{13}$ Ωcm or more.

These binder resins can be used alone or as a mixture of two or more.

The mixing ratio by weight of the charge generation material to the binder resin is preferably within a range of 10:1 to 1:10.

The charge generation layer may contain other known additives.

A method for forming the charge generation layer is not particularly limited, and a known forming method can be used. For example, a coating film of a coating solution for forming the charge generation layer, which is prepared by adding the components described above to a solvent, is formed, dried, and, if required, heated. The charge generation layer may be formed by vapor deposition of the charge generation material. The formation of the charge generation layer by vapor deposition is particularly preferred when a condensed ring aromatic pigment or perylene pigment is used as the charge generation material.

Examples of the solvent for preparing the coating solution for forming the charge generation layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, toluene, and the like. These solvents may be used alone or as a mixture of two or more.

Examples of a method for dispersing particles (for example, the charge generation material) in the coating solution for forming the charge generation layer include media dispersers such as a ball mill, a vibrating ball mill, an attritor, a sand mill, a horizontal sand mill, and the like; media-less dispersers such stirring, an ultrasonic disperser, a roll mill, a high-pressure homogenizer, and the like. The high-pressure homogenizer is, for example, a colliding dispersion method of liquid-liquid collision or liquid-wall collision of a dispersion solution under high pressure, a through dispersion method of passing through a fine flow passage under high pressure, or the like.

During the dispersion, the effective average particle diameter of the charge generation material in the coating solution for forming the charge generation layer is 0.5 μm or less, preferably 0.3 μm or less, and more preferably 0.15 μm or less.

Examples of a method for applying the coating solution for forming the charge generation layer on the undercoat layer (or the intermediate layer) include a blade coating method, a wire bar coating method, a spray coating method, a dip coating method, a bead coating method, an air knife coating method, a curtain coating method, and the like.

The thickness of the charge generation layer is, for example, preferably determined within a range of 0.1 μm or more and 5.0 μm or less and more preferably 0.2 μm or more and 2.0 μm or less.

(Charge Transport Layer)

The transport layer is, for example, a layer containing a charge transport material and a binder resin. The charge transport layer may be a layer containing a polymer charge transport material.

Examples of the charge transport material include electron transport compounds such as quinone compounds, such as p-benzoquinone, chloranil, bromanil, anthraquinone, and the like; tetracyanoquinodimethane compounds; fluorenone compounds, such as 2,4,7-trinitrofluorenone and the like; xanthone compounds; benzophenone compounds; cyanovinyl compounds; ethylenic compounds; and the like. Other examples of the charge transport material include hole transport compounds such as triarylamine compounds, benzidine compounds, arylalkane compounds, aryl-substituted ethylenic compounds, stilbene compounds, anthracene compounds, hydrazone compounds, and the like. These charge transport materials can be used alone or in combination of two or more, but the charge transport material is not limited to these.

From the viewpoint of charge mobility, the charge transport material is preferably a triarylamine charge transport material (also referred to as a "triarylamine charge transport material (a-1)" hereinafter) represented by general formula (a-1) below. Examples of the triarylamine charge transport material include a charge transport material (also referred to as a "butadiene charge transport material (CT1)" hereinafter) represented by general formula (CT1) below and a charge transport material (also referred to as a "benzidine charge transport material (CT2)" hereinafter) represented by general formula (CT2) below.

In addition, a combination of the butadiene charge transport material (CT1) and the benzidine charge transport material (CT2) may be used as the charge transport material.

The triarylamine charge transport material (a-1) is described.

The triarylamine charge transport material (a-1) is a charge transport material represented by the general formula (a-1) below.

(a-1)

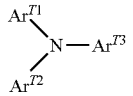

In the general formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$, and $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of a substituent of each of the groups include a halogen atom, an alkyl group having 1 or more and 5 or less carbon atoms, or an alkoxy group having 1 or more and 5 or less carbon atoms. Also, a substituted amino group substituted by an alkyl group having 1 or more and 3 or less carbon atoms may be used as the substituent of each of the groups.

The butadiene charge transport material (CT1) is described.

The butadiene charge transport material (CT1) is a charge transport material represented by the general formula (CT1) below.

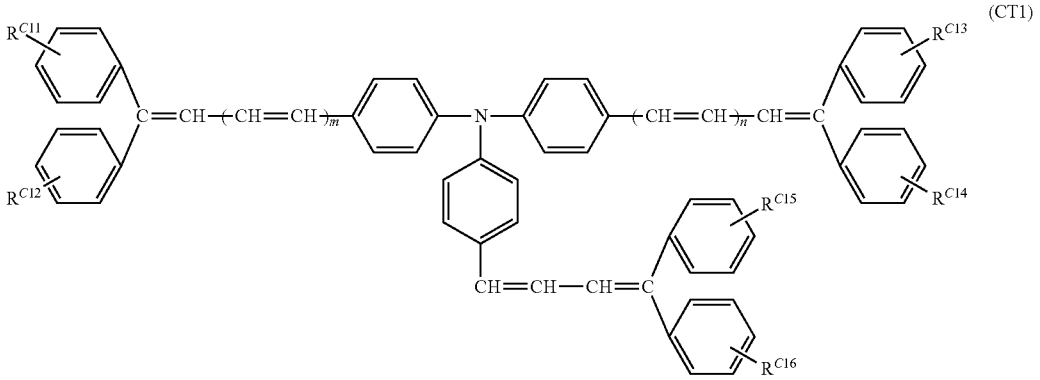

(CT1)

In the general formula (CT1), $R^{C11}$, $R^{C12}$, $R^{C13}$, $R^{C14}$, $R^{C15}$, and $R^{C16}$ each independently represent a hydrogen atom, a halogen atom, an alkyl group having 1 or more and 20 or less carbon atoms, an alkoxy group having 1 or more and 20 or less carbon atoms, or an aryl group having 6 or more and 30 or less carbon atoms. Also, the two adjacent substituents may be bonded to each other to form a hydrocarbon ring structure.

In addition, n and m each independently represent 0, 1, or 2.

Examples of the halogen atom represented by each of $R^{C11}$, $R^{C12}$, $R^{C13}$, $R^{C14}$, $R^{C15}$, and $R^{C16}$ in the general formula (CT1) include a fluorine atom, a chlorine atom, a bromine atom, an iodine atom, and the like. Among these, a fluorine atom or a chlorine atom is preferred as the halogen atom, and a chlorine atom is more preferred.

The alky group represented by each of $R^{C11}$, $R^{C12}$, $R^{C14}$, $R^{C15}$, and $R^{C16}$ in the general formula (CT1) is for example, a linear or branched alkyl group having 1 or more and 20 or less carbon atoms (preferably 1 or more and 6 or less and more preferably 1 or more and 4 or less).

Specific examples of the linear alkyl group include a methyl group, an ethyl group, a n-propyl group, a n-butyl group, a n-pentyl group, a n-hexyl group, a n-heptyl group, a n-octyl group, a n-nonyl group, a n-decyl group, a n-undecyl group, a n-dodecyl group, a n-tridecyl group, a n-tetradecyl group, a n-pentadecyl group, a n-hexadecyl group, a n-heptadecyl group, a n-octadecyl group, a n-nonadecyl group, a n-icosyl group, and the like.

Specific examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, a tert-decyl group, an isoundecyl group, a sec-undecyl group, a tert-undecyl group, a neoundecyl group, an isododecyl group, a sec-dodecyl group, a tert-dodecyl group, a neododecyl group, an isotridecyl group, a sec-tridecyl group, a tert-tridecyl group, a neotridecyl group, an isotetradecyl group, a sec-tetradecyl group, a tert-tetradecyl group, a neotetradecyl group, a 1-isobutyl-4-ethyloctyl group, an isopentadecyl group, a sec-pentadecyl group, a tert-pentadecyl group, a neopentadecyl group, an isohexadecyl group, a sec-hexadecyl group, a tert-hexadecyl group, a neohexadecyl group, a 1-methylpentadecyl group, an isoheptadecyl group, a sec-heptadecyl group, a tert-heptadecyl group, a neoheptadecyl group, an isooctadecyl group, a sec-octadecyl group, a tert-octadecyl group, a neooctadecyl group, an isononadecyl group, a sec-nonadecyl group, a tert-nonadecyl group, a neononadecyl group, a 1-methyloctyl group, an isoicosyl group, a sec-icosyl group, a tert-icosyl group, a neoicosyl group, and the like.

Among these, lower alkyl groups such as a methyl group, an ethyl group, an isopropyl group, and the like are preferred as the alkyl group.

The alkoxy group represented by each of $R^{C11}$, $R^{C12}$, $R^{C13}$, $R^{C14}$, $R^{C15}$, and $R^{C16}$ in the general formula (CT1) is for example, a linear or branched alkoxy group having 1 or more and 20 or less carbon atoms (preferably 1 or more and 6 or less and more preferably 1 or more and 4 or less).

Specific examples of the linear alkoxy group include a methoxy group, an ethoxy group, a n-propoxy group, a n-butoxy group, a n-pentyloxy group, a n-hexyloxy group, a n-heptyloxy group, a n-octyloxy group, a n-nonyloxy group, a n-decyloxy group, a n-undecyloxy group, a n-dodecyloxy group, a n-tridecyloxy group, a n-tetradecyloxy group, a n-pentadecyloxy group, a n-hexadecyloxy group, a n-heptadecyloxy group, a n-octadecyloxy group, a n-nonadecyloxy group, a n-icosyloxy group, and the like.

Specific examples of the branched alkoxy group include an isopropoxy group, an isobutoxy group, a sec-butoxy group, a tert-butoxy group, an isopentyloxy group, a neopentyloxy group, a tert-pentyloxy group, an isohexyloxy group, a sec-hexyloxy group, a tert-hexyloxy group, an isoheptyloxy group, a sec-heptyloxy group, a tert-heptyloxy group, an isooctyloxy group, a sec-octyloxy group, a tert-octyloxy group, an isononyloxy group, a sec-nonyloxy group, a tert-nonyloxy group, an isodecyloxy group, a sec-decyloxy group, a tert-decyloxy group, an isoundecyloxy group, a sec-undecyloxy group, a tert-undecyloxy group, a neoundecyloxy group, an isododecyloxy group, a sec-dodecyloxy group, a tert-dodecyloxy group, a neododecyloxy group, an isotridecyloxy group, a sec-tridecyloxy group, a tert-tridecyloxy group, a neotridecyloxy group, an isotetradecyloxy group, a sec-tetradecyloxy group, a tert-tetradecyloxy group, a neotetradecyloxy group, a 1-isobutyl-4-ethyloctyloxy group, an isopentadecyloxy group, a sec-pentadecyloxy group, a tert-pentadecyloxy group, a neopentadecyloxy group, an isohexadecyloxy group, a sec-hexadecyloxy group, a tert-hexadecyloxy group, a neohexadecyloxy group, a 1-methylpentadecyloxy group, an isoheptadecyloxy group, a sec-heptadecyloxy group, a tert-heptadecyloxy group, a neoheptadecyloxy group, an isooctadecyloxy group, a sec-octadecyloxy group, a tert-octadecyloxy group, a neooctadecyloxy group, an isononadecyloxy group, a sec-nonadecyloxy group, a tert-nonadecyloxy group, a neononadecyloxy group, a 1-methyloctyloxy group, an isoicosyloxy group, a sec-icosyloxy group, a tert-icosyloxy group, a neoicosyloxy group, and the like.

Among these, a methoxy group is preferred as the alkoxy group.

The aryl group represented by each of $R^{C11}$, $R^{C12}$, $R^{C13}$, $R^{C14}$, $R^{C15}$, and $R^{C16}$ in the general formula (CT1) is for example, an aryl group having 6 or more and 30 or less carbon atoms (preferably 6 or more and 20 or less and more preferably 6 or more and 16 or less).

Specific examples of the aryl group include a phenyl group, a naphthyl group, a phenanthryl group, a biphenyl group, and the like.

Among these, a phenyl group and a naphthyl group are preferred as the aryl group.

The substituent represented by each of $R^{C11}$, $R^{C12}$, $R^{C13}$, $R^{C14}$, $R^{C15}$, and $R^{C16}$ in the general formula (CT1) includes a group further having a substituent. Examples of the substituent include the atoms and groups exemplified above (for example, a halogen atom, an alkyl group, an alkoxy group, an aryl group, and the like).

In the hydrocarbon ring structure in which two adjacent substituents of $R^{C11}$, $R^{C12}$, $R^{C13}$, $R^{C14}$, $R^{C15}$, and $R^{C16}$ in the general formula (CT1) (for example, $R^{C11}$ and $R^{C12}$, $R^{C13}$ and $R^{C14}$, or $R^{C15}$ and $R^{c16}$) are connected to each other, examples of a connecting group between the two adjacent substituents include a single bond, a 2,2'-methylene group, a 2,2'-ethylene group, a 2,2' vinylene group, and the like. Among these, a 2,2'-methylene group is preferred.

Examples of the hydrocarbon ring structure include a cycloalkane structure, a cycloalkene structure, a cycloalkanepolyene structure, and the like.

In the general formula (CT1), n and m are preferably 1.

From the viewpoint of forming the photosensitive layer (charge transport layer) having high charge transportability, $R^{C11}$, $R^{C12}$, $R^{C13}$, $R^{C14}$, $R^{C15}$, and $R^{C16}$ in the general formula (CT1) preferably each represent a hydrogen atom, an alkyl group having 1 or more and 20 or less carbon atoms or an alkoxy group having 1 or more and 20 or less carbon atoms, and m and n preferably each represent 1 or 2, and $R^{C11}$, $R^{C12}$, $R^{C13}$, $R^{C14}$, $R^{C15}$, and $R^{C16}$ more preferably each represent a hydrogen atom, and m and n preferably each represent 1.

That is, the butadiene charge transport material (CT1) is more preferably a charge transport material (exemplified compound (CT1-3) represented by a structural formula (CTIA) below.

(CT1A)

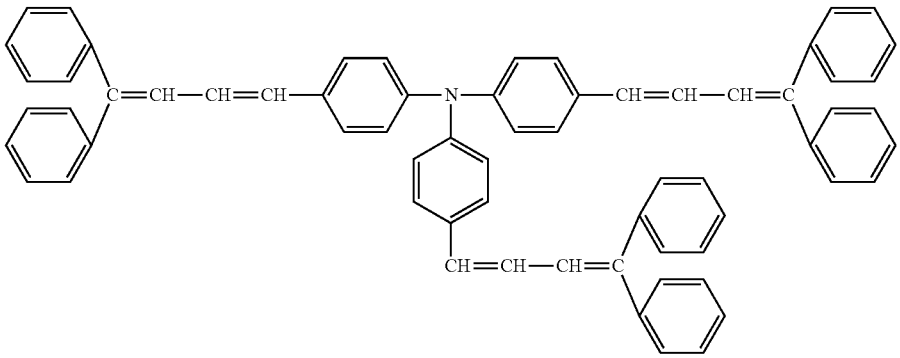

Examples of the butadiene charge transport material (CT1) are described below, but the butadiene charge transport material (CT1) is not limited to these examples.

| Exemplified compound No. | m | n | $R^{C11}$ | $R^{C12}$ | $R^{C13}$ | $R^{C14}$ | $R^{C15}$ | $R^{C16}$ |
|---|---|---|---|---|---|---|---|---|
| CT1-1 | 1 | 1 | 4-$CH_3$ | 4-$CH_3$ | 4-$CH_3$ | 4-$CH_3$ | H | H |
| CT1-2 | 2 | 2 | H | H | H | H | 4-$CH_3$ | 4-$CH_3$ |
| CT1-3 | 1 | 1 | H | H | H | H | H | H |
| CT1-4 | 2 | 2 | H | H | H | H | H | H |
| CT1-5 | 1 | 1 | 4-$CH_3$ | 4-$CH_3$ | 4-$CH_3$ | H | H | H |
| CT1-6 | 0 | 1 | H | H | H | H | H | H |
| CT1-7 | 0 | 1 | 4-$CH_3$ | 4-$CH_3$ | 4-$CH_3$ | 4-$CH_3$ | 4-$CH_3$ | 4-$CH_3$ |
| CT1-8 | 0 | 1 | 4-$CH_3$ | 4-$CH_3$ | H | H | 4-$CH_3$ | 4-$CH_3$ |
| CT1-9 | 0 | 1 | H | H | 4-$CH_3$ | 4-$CH_3$ | H | H |
| CT1-10 | 0 | 1 | H | H | 3-$CH_3$ | 3-$CH_3$ | H | H |
| CT1-11 | 0 | 1 | 4-$CH_3$ | H | H | H | 4-$CH_3$ | H |
| CT1-12 | 0 | 1 | 4-$OCH_3$ | H | H | H | 4-$OCH_3$ | H |
| CT1-13 | 0 | 1 | H | H | 4-$OCH_3$ | 4-$OCH_3$ | H | H |
| CT1-14 | 0 | 1 | 4-$OCH_3$ | H | 4-$OCH_3$ | H | 4-$OCH_3$ | 4-$OCH_3$ |
| CT1-15 | 0 | 1 | 3-$CH_3$ | H | 3-$CH_3$ | H | 3-$CH_3$ | H |
| CT1-16 | 0 | 1 | 4-$CH_3$ | 4-$CH_3$ | 4-$CH_3$ | 4-$CH_3$ | 4-$CH_3$ | 4-$CH_3$ |
| CT1-17 | 1 | 1 | 4-$CH_3$ | 4-$CH_3$ | H | H | 4-$CH_3$ | 4-$CH_3$ |
| CT1-18 | 1 | 1 | H | H | 4-$CH_3$ | 4-$CH_3$ | H | H |
| CT1-19 | 1 | 1 | H | H | 3-$CH_3$ | 3-$CH_3$ | H | H |
| CT1-20 | 1 | 1 | 4-$CH_3$ | H | H | H | 4-$CH_3$ | H |
| CT1-21 | 1 | 1 | 4-$OCH_3$ | H | H | H | 4-$OCH_3$ | H |
| CT1-22 | 1 | 1 | H | H | 4-$OCH_3$ | 4-$OCH_3$ | H | H |
| CT1-23 | 1 | 1 | 4-$OCH_3$ | H | 4-$OCH_3$ | H | 4-$OCH_3$ | 4-$OCH_3$ |
| CT1-24 | 1 | 1 | 3-$CH_3$ | H | 3-$CH_3$ | H | 3-$CH_3$ | H |

The abbreviations in the exemplified compounds represent the following meanings. The number assigned before a substituent represents a substitution position with respect to a benzene ring.

$CH_3$: methyl group $OCH_3$: methoxy group

These butadiene charge transport materials (CT1) may be used alone or in combination of two or more.

The benzidine charge transport material (CT2) is described.

The benzidine charge transport material (CT2) is a charge transport material represented by the general formula (CT2) below.

(CT2)

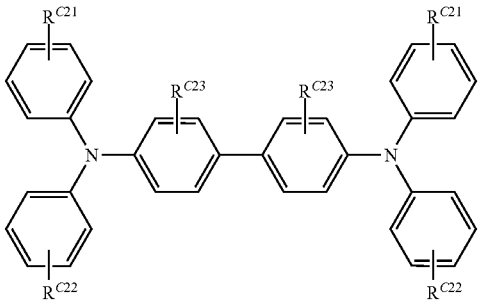

In the general formula (CT2), $R^{C21}$, $R^{C22}$, and $R^{C23}$ each independently represent a hydrogen atom, a halogen atom, an alkyl group having 1 or more and 10 or less carbon atoms, an alkoxy group having 1 or more and 10 or less carbon atoms, or an aryl group having 6 or more and 10 or less carbon atoms.

Examples of the halogen atom represented by each of $R^{C21}$, $R^{C22}$, and $R^{C23}$ in the general formula (CT2) include a fluorine atom, a chlorine atom, a bromine atom, an iodine atom, and the like. Among these, a fluorine atom and a chlorine atom are preferred as the halogen atom, and a chlorine atom is more preferred.

The alky group represented by each of $R^{C21}$, $R^{C22}$, and $R^{C23}$ in the general formula (CT2) is, for example, a linear or branched alkyl group having 1 or more and 10 or less carbon atoms (preferably 1 or more and 6 or less and more preferably 1 or more and 4 or less).

Specific examples of the linear alkyl group include a methyl group, an ethyl group, an n-propyl group, an n-butyl group, an n-pentyl group, an n-hexyl group, an n-heptyl group, an n-octyl group, an n-nonyl group, an n-decyl group, and the like.

Specific examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, a tert-decyl group, and the like.

Among these, lower alkyl groups such as a methyl group, an ethyl group, an isopropyl group, and the like are preferred as the alkyl group.

The alkoxy group represented by each of $R^{C21}$, $R^{C22}$, and $R^{C23}$ in the general formula (CT2) is, for example, a linear or branched alkoxy group having 1 or more and 10 or less carbon atoms (preferably 1 or more and 6 or less and more preferably 1 or more and 4 or less).

Specific examples of the linear alkoxy group include a methoxy group, an ethoxy group, an n-propoxy group, an n-butoxy group, an n-pentyloxy group, an n-hexyloxy group, an n-heptyloxy group, an n-octyloxy group, an n-nonyloxy group, an n-decyloxy group, and the like.

Specific examples of the branched alkoxy group include an isopropoxy group, an isobutoxy group, a sec-butoxy group, a tert-butoxy group, an isopentyloxy group, a neopentyloxy group, a tert-pentyloxy group, an isohexyloxy group, a sec-hexyloxy group, a tert-hexyloxy group, an isoheptyloxy group, a sec-heptyloxy group, a tert-heptyloxy group, an isooctyloxy group, a sec-octyloxy group, a tert-octyloxy group, an isononyloxy group, a sec-nonyloxy group, a tert-nonyloxy group, an isodecyloxy group, a sec-decyloxy group, a tert-decyloxy group, and the like.

Among these, a methoxy group is preferred as the alkoxy group.

The aryl group represented by each of $R^{C21}$, $R^{C22}$, and $R^{C23}$ in the general formula (CT2) is, for example, an aryl group having 6 or more and 10 or less carbon atoms (preferably 6 or more and 9 or less and more preferably 6 or more and 8 or less).

Specific examples of the aryl group include a phenyl group, a naphthyl group, and the like.

Among these, a phenyl group is preferred as the aryl group.

The substituent represented by each of $R^{C21}$, $R^{C22}$, and $R^{C23}$ in the general formula (CT2) contains a group further having a substituent. Examples of the substituent include the atoms and groups exemplified above (for example, a halogen atom, an alkyl group, an alkoxy group, an aryl group, and the like).

From the viewpoint of forming the photosensitive layer (charge transport layer) having high charge transportability, $R^{C21}$, $R^{C22}$, and $R^{C23}$ in the general formula (CT2) preferably each represent a hydrogen atom or an alkyl group having 1 or more and 10 or less carbon atoms, and $R^{C21}$ and $R^{C23}$ more preferably each represent a hydrogen atom, and $R^{C22}$ more preferably represents an alkyl group (particularly a method group) having 1 or more and 10 or less carbon atoms.

Specifically, the benzidine charge transport material (CT2) is particularly preferably a charge transport material (exemplified compound (CT2-2)) represented by a structural formula (CT2A) below.

(CT2A)

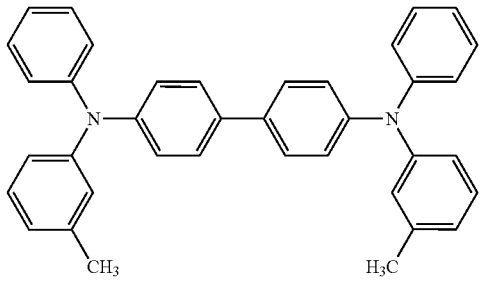

Examples of the benzidine charge transport material (CT2) are described below, but the benzidine charge transport material (CT2) is not limited to these examples.

| Exemplified compound No. | $R^{C21}$ | $R^{C22}$ | $R^{C23}$ |
|---|---|---|---|
| CT2-1 | H | H | H |
| CT2-2 | H | 3—$CH_3$ | H |
| CT2-3 | H | 4—$CH_3$ | H |
| CT2-4 | H | 3—$C_2H_5$ | H |
| CT2-5 | H | 4—$C_2H_5$ | H |
| CT2-6 | H | 3—$OCH_3$ | H |
| CT2-7 | H | 4—$OCH_3$ | H |

-continued

| Exemplified compound No. | $R^{C21}$ | $R^{C22}$ | $R^{C23}$ |
|---|---|---|---|
| CT2-8 | H | 3—$OC_2H_5$ | H |
| CT2-9 | H | 4—$OC_2H_5$ | H |
| CT2-10 | 3—$CH_3$ | 3—$CH_3$ | H |
| CT2-11 | 4—$CH_3$ | 4—$CH_3$ | H |
| CT2-12 | 3—$C_2H_5$ | 3—$C_2H_5$ | H |
| CT2-13 | 4—$C_2H_5$ | 4—$C_2H_5$ | H |
| CT2-14 | H | H | 2—$CH_3$ |
| CT2-15 | H | H | 3—$CH_3$ |
| CT2-16 | H | 3—$CH_3$ | 2—$CH_3$ |
| CT2-17 | H | 3—$CH_3$ | 3—$CH_3$ |
| CT2-18 | H | 4—$CH_3$ | 2—$CH_3$ |
| CT2-19 | H | 4—$CH_3$ | 3—$CH_3$ |
| CT2-20 | 3—$CH_3$ | 3—$CH_3$ | 2—$CH_3$ |
| CT2-21 | 3—$CH_3$ | 3—$CH_3$ | 3—$CH_3$ |
| CT2-22 | 4—$CH_3$ | 4—$CH_3$ | 2—$CH_3$ |
| CT2-23 | 4—$CH_3$ | 4—$CH_3$ | 3—$CH_3$ |

The abbreviations in the exemplified compounds represent the following meanings. The number assigned before a substituent represents a substitution position with respect to a benzene ring.

$CH_3$: methyl group $C_2H_5$: ethyl group $OCH_3$: methoxy group $OC_2H_5$: ethoxy group These benzidine charge transport materials (CT2) may be used alone or in combination of two or more.

Examples used as the polymer charge transport material include known materials having charge transportability, such as poly-N-vinylcarbazole, polysilane, and the like. In particular, polyester-based polymer charge transport materials are particularly preferred. The polymer charge transport materials may be used alone or in combination of two or more.

Examples of the binder resin used in the charge transport layer include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol-formaldehyde resin, a styrene-alkyd resin, poly-N-vinylcarbazole, polysilane, and the like. Among these, a polycarbonate resin or polyarylate resin is preferred as the binder resin. These binder resins can be used alone or in combination of two or more.

The mixing ratio by weight of the charge transport material to the binder resin is preferably 10:1 to 1:5.

The charge transport layer may contain other known additives.

A method for forming the charge transport layer is not particularly limited, and a known forming method can be used. For example, a coating film of a coating solution for forming the charge transport layer, which is prepared by adding the components described above to a solvent, is formed, dried, and, if required, heated.

Examples of the solvent for preparing the coating solution for forming the charge transport layer include usual organic solvents, such as aromatic hydrocarbons, such as benzene, toluene, xylene, chlorobenzene, and the like; ketones, such as acetone, 2-butanone, and the like; halogenated aliphatic hydrocarbons, such as methylene chloride, chloroform, ethylene chloride, and the like; cyclic or linear ethers, such as tetrahydrofuran, ethyl ether, and the like; and the like. These solvents may be used alone or as a mixture of two or more.

Examples of a method for applying the coating solution for forming the charge transport layer on the charge generation layer include usual methods such as a blade coating method, a wire bar coating method, a spray coating method, a dip coating method, a bead coating method, an air knife coating method, a curtain coating method, and the like.

The thickness of the charge transport layer is, for example, preferably determined within a range of 5 μm or more and 50 μm or less and more preferably 10 μm or more and 30 μm or less.

(Protective Layer)

If required, a protective layer is provided on the photosensitive layer. The protective layer is provided, for example, for preventing a chemical change of the photosensitive layer during charging and further improving the mechanical strength of the photosensitive layer.

Therefore, a layer including a cured film (crosslinked film) may be used as the protective layer. Such a layer is, for example, a layer 1) or 2) described below.

1) A layer including a cured film of a composition which contains a reactive group-containing charge transport material having a reactive group and a charge transport skeleton in the same molecule (that is, a layer containing a polymer or crosslinked product of the reactive group-containing charge transport material).

2) A layer including a cured film of a composition which contains a nonreactive charge transport material and a reactive group-containing non-charge transport material having a reactive group without a charge transport skeleton (that is, a layer containing the nonreactive charge transport material and a polymer or crosslinked product of the reactive group-containing non-charge transport material).

Examples of the reactive group of the reactive group-containing charge transport material include known reactive groups such as a chain-polymerizable group, an epoxy group, —OH, —OR [wherein R represents an alkyl group], —$NH_2$, —SH, —COOH, —$SiR^{Q1}{}_{3-Qn}(OR^{Q2})_{Qn}$ [wherein $R^{Q1}$ represents a hydrogen atom, an alkyl group, or a substituted or unsubstituted aryl group, $R^{Q2}$ represents a hydrogen atom, an alkyl group, or a trialkylsilyl group, and Qn represents an integer of 1 to 3], and the like.

The chain-polymerizable group is not particularly limited as long as it is a radically polymerizable functional group, and is, for example, a functional group having a group containing at least a carbon double bond. Specific examples thereof include a group containing at least one selected from a vinyl group, a vinyl ether group, a vinyl thioether group, a vinyl phenyl group, an acryloyl group, a methacryloyl group, and derivatives thereof, and the like. In particular, in view of excellent reactivity, the chain-polymerizable group is preferably a group containing at least one selected from a vinyl group, a vinyl phenyl group, an acryloyl group, a methacryloyl group, and derivatives thereof.

The charge transport skeleton of the reactive group-containing charge transport material is not particularly limited as long as it has a known structure for an electrophotographic photoreceptor. For example, the skeleton is derived from a nitrogen-containing hole transport compound such as a triarylamine compound, a benzidine compound, a hydrazine compound, or the like, and has a structure conjugated with a nitrogen atom. Among these, a triarylamine skeleton is preferred.

The reactive group-containing charge transport material having the reactive group and the charge transport skeleton, the unreactive charge transport material, and the reactive group-containing non-charge transport material may be selected from known materials.

The protective layer may contain other known additives.

A method for forming the protective layer is not particularly limited, and a known forming method can be used. For example, a coating film of a coating solution for forming the protective layer, which is prepared by adding the components described above to a solvent, is formed, dried, and, if required, cured by heating or the like.

Examples of the solvent for preparing the coating solution for forming the protective layer include aromatic solvents, such as toluene, xylene, and the like; ketone solvents, such as methyl ethyl ketone, methyl isobutyl ketone, cyclohexanone, and the like; ester solvents such as ethyl acetate, butyl acetate, and the like; ether solvents such as tetrahydrofuran, dioxane, and the like; cellosolve solvents such as ethylene glycol monomethyl ether and the like; alcohol solvents such as isopropyl alcohol, butanol, and the like; and the like. These solvents may be used alone or as a mixture of two or more.

The coating solution for forming the protective layer may be a solvent-free coating solution.

Examples of a method for applying the coating solution for forming the protective layer on the photosensitive layer (for example, the charge transport layer) include a dip coating method, a push-up coating method, a wire bar coating method, a spray coating method, a blade coating method, a knife coating method, a curtain coating method, and the like.

The thickness of the protective layer is, for example, preferably determined within a range of 1 μm or more and 20 μm or less and more preferably 2 μm or more and 10 μm or less.

(Single-Layer Photosensitive Layer)

A single-layer photosensitive layer (charge generation/charge transport layer) is, for example, a layer containing a charge generation material, a charge transport material, and, if required, a binder resin and other known additives. These materials are the same as the materials described for the charge generation layer and the charge transport layer.

The content of the charge generation material in the single-layer photosensitive layer is 0.1% by weight or more and 10% by weight or less and preferably 0.8% by weight or more and 5% by weight or less relative to the total solid content. The content of the charge transport material in the single-layer photosensitive layer is 5% by weight or more and 50% by weight or less relative to the total solid content.

A method for forming the single-layer photosensitive layer is the same as the method for forming the charge generation layer and the charge transport layer.

The thickness of the single-layer photosensitive layer is, for example, preferably determined within a range of 5 μm or more and 50 μm or less and preferably 10 μm or more and 40 μm or less.

[Image Forming Apparatus (and Process Cartridge)]

An image forming apparatus according to an exemplary embodiment of the present disclosure includes an electrophotographic photoreceptor, a charging unit which charges the surface of the electrophotographic photoreceptor, an electrostatic latent image forming unit which forms an electrostatic latent image on the charged surface of the electrophotographic photoreceptor, a developing unit which forms a toner image by developing the electrostatic latent image formed on the surface of the electrophotographic photoreceptor with a developer containing a toner, and a transfer unit which transfers the toner image to the surface of a recording medium. The electrophotographic photoreceptor according to the exemplary embodiment described above is used as the electrophotographic photoreceptor.

Examples applied to the image forming apparatus according to the exemplary embodiment include known image forming apparatuses such as an apparatus including a fixing unit which fixes a toner image transferred to the surface of a recording medium; an apparatus of a direct transfer system in which a toner image formed on the surface of an electrophotographic photoreceptor is transferred directly to a recording medium; an apparatus of an intermediate transfer system in which a toner image formed on the surface of an electrophotographic photoreceptor is first transferred to the surface of an intermediate transfer body, and the toner image transferred to the surface of the intermediate transfer body is second transferred to the surface of a recording medium; an apparatus including a cleaning unit which cleans the surface of an electrophotographic photoreceptor after transfer of a toner image and before charging; an apparatus including a static eliminating unit which eliminates electricity by irradiating the surface of an electrophotographic photoreceptor with static eliminating light after transfer of a toner and before charging; an apparatus including an electrophotographic photoreceptor heating member which decreases a relative temperature by increasing the temperature of an electrophotographic photoreceptor; and the like.

In the case of the apparatus of an intermediate transfer system, a configuration applied to the transfer unit includes, for example, an intermediate transfer body to the surface of which a toner image is transferred, a first transfer unit which first transfers the toner image formed on the surface of the electrophotographic photoreceptor to the surface of the intermediate transfer body, and a second transfer unit which second transfers the toner image transferred to the surface of the intermediate transfer body to the surface of a recording medium.

The image forming apparatus according to the exemplary embodiment may be either an image forming apparatus of a dry development system or an image forming apparatus of a wet development system (development system using a liquid developer).

In the image forming apparatus according to the exemplary embodiment, for example, a part provided with the electrophotographic photoreceptor may have a cartridge structure (process cartridge) detachable from the image forming apparatus. For example, a process cartridge provided with the electrophotographic receptor according to the exemplary embodiment is preferably used as the process cartridge. Beside the electrophotographic photoreceptor, the process cartridge may include, for example, at least one selected from the group consisting of a charging unit, an electrostatic latent image forming unit, a developing unit, and a transfer unit.

An example of the image forming apparatus according to the exemplary embodiment is described below, but the image forming apparatus is not limited to this. The principal parts shown in the drawings are described below, and the other parts are not described.

Figure 4:
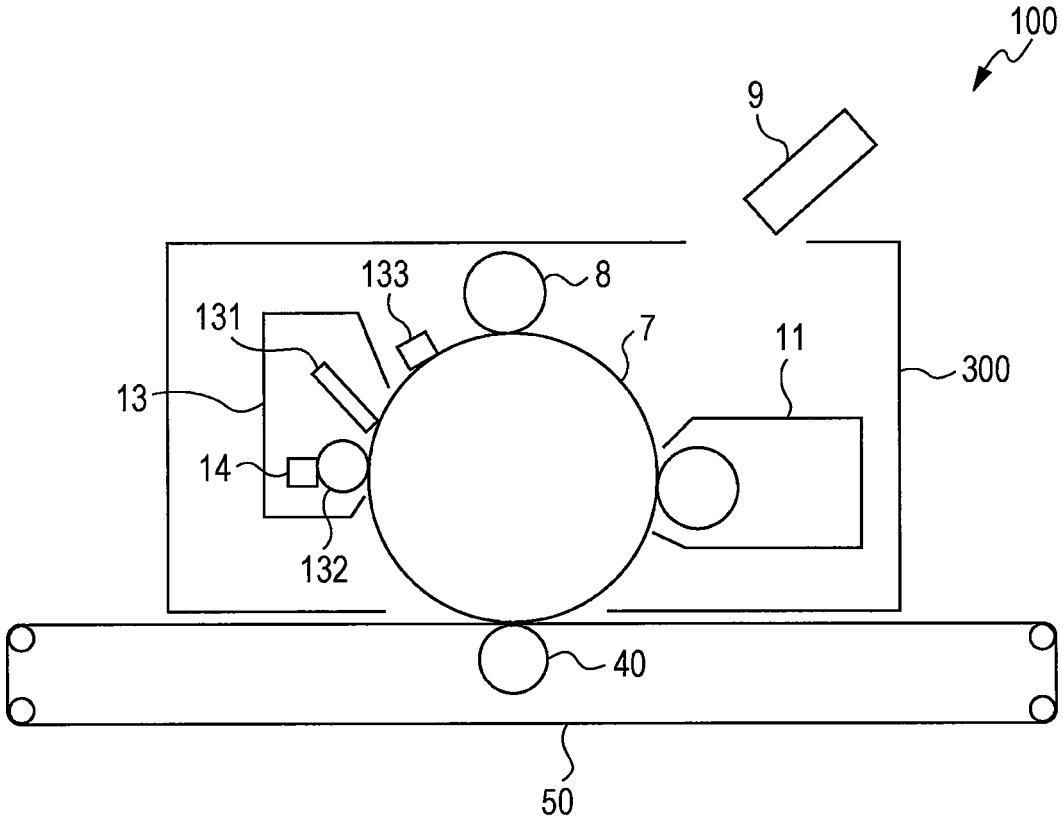
FIG. 4 is a schematic configuration diagram showing an example of an image forming apparatus according to an exemplary embodiment of the present disclosure.

FIG. 4 is a schematic configuration diagram showing an example of the image forming apparatus according to the exemplary embodiment.

As shown in FIG. 4, an image forming apparatus 100 according to the exemplary embodiment includes a process cartridge 300 provided with an electrophotographic photoreceptor 7, an exposure device 9 (an example of the electrostatic latent image forming unit), a transfer device 40 (first transfer device), and an intermediate transfer body 50. In the image forming apparatus 100, the exposure device 9 is disposed at a position where the electrophotographic photoreceptor 7 can be exposed from an opening of the process cartridge 300, the transfer device 4 is disposed at a position facing the electrophotographic photoreceptor 7 through the intermediate transfer body 50, and the intermediate transfer body 50 is disposed so as to be partially in contact with the electrophotographic photoreceptor 7. Although not shown in the drawings, there is also provided a second transfer device which transfers a toner image transferred to the intermediate transfer body 50 to a recording medium (for example, paper). The intermediate transfer body 50, the transfer device 40 (first transfer device), and the second transfer device (not shown) correspond to an example of the transfer unit.

The process cartridge 300 shown in FIG. 4 includes a housing in which the electrophotographic photoreceptor 7, a charging device 8 (an example of the charging unit), a developing device 11 (an example of the developing unit), and a cleaning device 13 (an example of the cleaning unit) are integrally supported. The cleaning device 13 has a cleaning blade (an example of the cleaning member) 131 which is disposed in contact with the surface of the electrophotographic photoreceptor 7. The cleaning member may not have the form of the cleaning blade 131 and may be a conductive or insulating fibrous member, which may be used singly or in combination with the cleaning blade 131.

FIG. 4 shows an example of the image forming apparatus which includes a fibrous member 132 (roll-shaped) which supplies a lubricant 14 to the surface of the electrophotographic photoreceptor 7 and a fiber member 133 (brush-shaped) which supports cleaning, and these are disposed according to demand.

Each of the constituent components of the image forming apparatus according to the exemplary embodiment is described below.

—Charging Device—

The charging device 8 used is, for example, a contact-type charger using a conductive or semiconductive charging roller, charging brush, charging film, charging rubber blade, charging pipe, or the like. Also used is a known charger such as a non-contact type roller charger, a scorotron charger or corotron charger using corona discharge, or the like.

—Exposure Device—

The exposure device 9 is, for example, an optical system device in which the surface of the electrophotographic photoreceptor 7 is exposed in a predetermined image pattern with light such as semiconductor laser light, LED light, liquid crystal shutter light, or the like. The wavelength of a light source is within the spectral sensitivity range of the electrophotographic photoreceptor. The mainstream of the semiconductor laser is near-infrared light having an oscillation wavelength near 780 nm. However, the wavelength is not limited to this, and a laser having an oscillation wavelength of the order of 600 nm or a blue laser having an oscillation wavelength of 400 nm or more and 450 nm or less may be used. Also, a surface-emission laser light source of a type capable of outputting multi-beams is effective for forming color images.

—Developing Device—

The developing device 11 is, for example, a general developing derive which develops by contact or non-contact with the developer. The developing device 11 is not particularly limited as long as it has the function described above and is selected according to the purpose. Examples thereof include a known developing unit having the function of adhering a one-component developer or two-component developer to the electrophotographic photoreceptor 7 by using a brush, a roller, or the like, and the like. In particular, a developing roller holding the developer on the surface thereof is preferably used.

The developer used in the developing device 11 may be either a one-component developer containing only a toner or a two-component developer containing a toner and a carrier. The developer may be either magnetic or nonmagnetic. A known developer is applied to the developer.

—Cleaning Device—

The cleaning device 13 used is a cleaning blade-system device provided with the cleaning blade 131.

Other than the cleaning blade system, a fur brush cleaning system and a simultaneous development cleaning system may be used.

—Transfer Device—

Examples of the transfer device 40 include known transfer chargers such as a contact-type transfer charger using a belt, a roller, a film, a rubber blade, or the like, a scorotron transfer charger or corotron transfer charger using corona discharge, and the like.

—Intermediate Transfer Body—

The intermediate transfer body 50 used is a belt-shaped body (intermediate belt) containing polyimide, polyamide-imide, polycarbonate, polyarylate, polyester, rubber or the like, which is imparted with semiconductivity. The form of the intermediate transfer body used may be a drum shape other than the belt shape.

Figure 5:
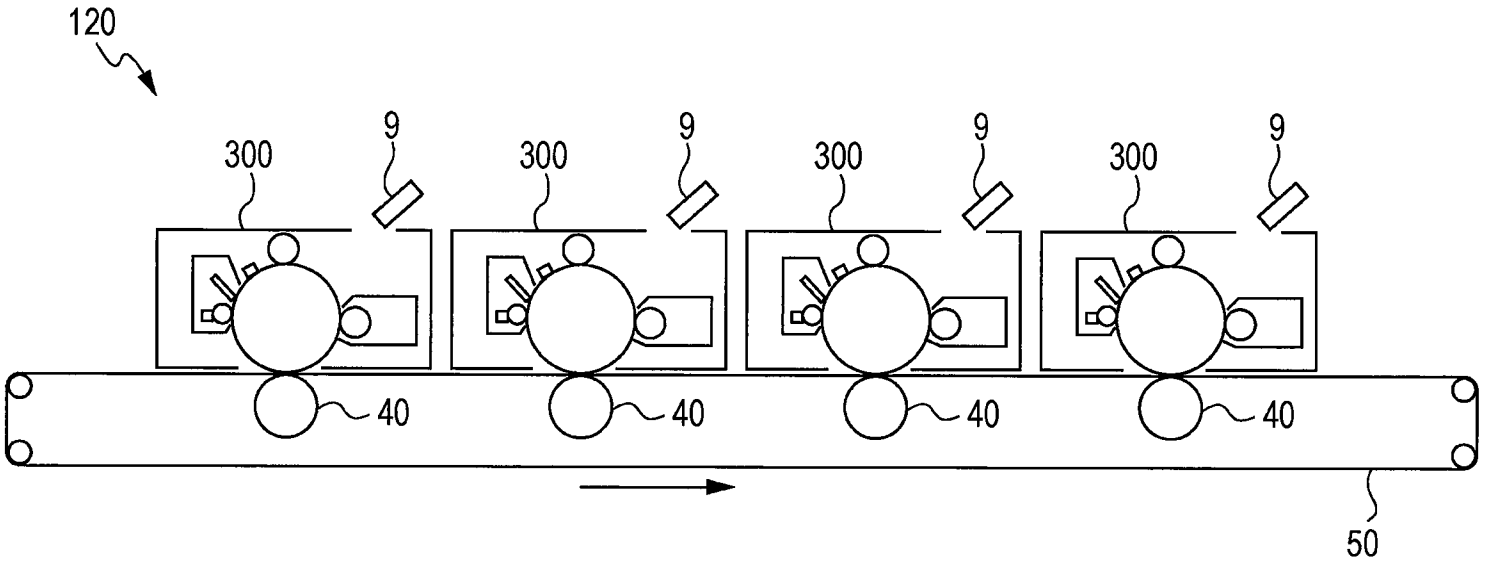
FIG. 5 is a schematic configuration diagram showing another example of an image forming apparatus according to an exemplary embodiment of the present disclosure.

FIG. 5 is a schematic configuration diagram showing another example of the image forming apparatus according to the exemplary embodiment.

An image forming apparatus 120 shown in FIG. 5 is a tandem-system multicolor image forming apparatus provided with four process cartridges 300. The image forming apparatus 120 has a configuration in which the four process cartridges 300 are disposed in parallel on the intermediate transfer body 50, and one electrophotographic photoreceptor is used for one color. The image forming apparatus 120 has the same configuration as the image forming apparatus 100 except that it is a tandem system.

EXAMPLES

Examples of the present disclosure are described below, but the present disclosure is not limited to these examples below. In addition, "parts" represents "parts by weight" unless otherwise specified.

<Formation of Conductive Support>

—Formation of Conductive Support (1)—

First, an aluminum alloy (JIS A6063 alloy) is extruded and drawn to form a pipe (element pipe), and the outer peripheral surface of the pipe is cut to form a conductive support having an outer diameter of 30 mm and a whole length of 365 mm. The lathe and processing conditions used for cutting the outer peripheral surface of the pipe are as follows. The arithmetic average waviness Wa, the peak count PPc, the maximum height Pz, etc. of the outer peripheral surface are adjusted by adjusting the clearance angle of a finishing tool with the pipe.

Photoreceptor drum outer diameter finishing CNC lathe: RL-550EX (manufactured by Eguro Ltd.)

Roughing tool specification: polycrystalline diamond

Finishing tool specification: single-crystal diamond

Roughing rate: number of principal shaft rotations=4000 rpm, feed rate=0.45 mm/rev Finishing rate: number of principal shaft rotations=4000 rpm, feed rate=0.45 mm/rev Table 1 shows the arithmetic average waviness Wa, peak count PPc, and maximum height Pz in the axial direction of the outer peripheral surface of the resultant conductive support.

—Formation of Conductive Support (2)—

A conductive support is formed by the same method as for the conductive support (1) except that with respect to a pipe, the clearance angle of a tool used for cutting the outer peripheral surface of the pipe is adjusted so that the arithmetic average waviness Wa, peak count PPc, and maximum height Pz in the axial direction of the outer peripheral surface are the values shown in Table 1.

Table 1 shows the arithmetic average waviness Wa, peak count PPc, and maximum height Pz in the axial direction of the outer peripheral surface of the resultant conductive support.

—Formation of Conductive Support (3)—

A conductive support is formed by the same method as for the conductive support (1) except that with respect to a pipe, the clearance angle of a tool used for cutting the outer peripheral surface of the pipe is adjusted so that the arithmetic average waviness Wa, peak count PPc, and maximum height Pz in the axial direction of the outer peripheral surface are the values shown in Table 1.

Table 1 shows the arithmetic average waviness Wa, peak count PPc, and maximum height Pz in the axial direction of the outer peripheral surface of the resultant conductive support.

—Formation of Conductive Support (4)—

A conductive support is formed by the same method as for the conductive support (1) except that with respect to a pipe, the clearance angle of a tool used for cutting the outer peripheral surface of the pipe is adjusted so that the arithmetic average waviness Wa, peak count PPc, and maximum height Pz in the axial direction of the outer peripheral surface are the values shown in Table 1.

Table 1 shows the arithmetic average waviness Wa, peak count PPc, and maximum height Pz in the axial direction of the outer peripheral surface of the resultant conductive support.

—Formation of Conductive Support (5)—

A conductive support is formed by the same method as for the conductive support (1) except that with respect to a pipe, the clearance angle of a tool used for cutting the outer peripheral surface of the pipe is adjusted so that the arithmetic average waviness Wa, peak count PPc, and maximum height Pz in the axial direction of the outer peripheral surface are the values shown in Table 1.

Table 1 shows the arithmetic average waviness Wa, peak count PPc, and maximum height Pz in the axial direction of the outer peripheral surface of the resultant conductive support.

—Formation of Conductive Support (6)—

A conductive support is formed by the same method as for the conductive support (1) except that with respect to a pipe, the clearance angle of a tool used for cutting the outer peripheral surface of the pipe is adjusted so that the arithmetic average waviness Wa, peak count PPc, and maximum height Pz in the axial direction of the outer peripheral surface are the values shown in Table 1.

Table 1 shows the arithmetic average waviness Wa, peak count PPc, and maximum height Pz in the axial direction of the outer peripheral surface of the resultant conductive support.

—Formation of Conductive Support (C1)—

A conductive support is formed by the same method as for the conductive support (1) except that with respect to a pipe, the clearance angle of a tool used for cutting the outer peripheral surface of the pipe is adjusted so that the arithmetic average waviness Wa, peak count PPc, and maximum height Pz in the axial direction of the outer peripheral surface are the values shown in Table 1.

Table 1 shows the arithmetic average waviness Wa, peak count PPc, and maximum height Pz in the axial direction of the outer peripheral surface of the resultant conductive support.

—Formation of Conductive Support (C2)—

A conductive support is formed by the same method as for the conductive support (1) except that with respect to a pipe, the clearance angle of a tool used for cutting the outer peripheral surface of the pipe is adjusted so that the arithmetic average waviness Wa, peak count PPc, and maximum height Pz in the axial direction of the outer peripheral surface are the values shown in Table 1.

Table 1 shows the arithmetic average waviness Wa, peak count PPc, and maximum height Pz in the axial direction of the outer peripheral surface of the resultant conductive support.

<Formation of Photoreceptor>

Photoreceptors (1) to (6), (C1), and (C2) are produced by using the resultant conductive supports (1) to (6), (C1), and (C2), respectively.

Specifically, an undercoat layer, a charge generation layer, and a charge transport layer are formed on the conductive support as follows.

Table 1 shows the arithmetic average roughness Ra in the axial direction on the outer peripheral surface of each of the resultant photoreceptors.

(Formation of Undercoat Layer)

First, 100 parts by weight of zinc oxide (trade name: MZ300, manufactured by TAYCA CORPORATION and 500 parts by weight of tetrahydrofuran are stirred and mixed, and 1.3 parts by weight of a silane coupling agent (KBM503: manufactured by Shin-Etsu Chemical Co., Ltd.) is added to the resultant mixture and stirred for 2 hours. Then, tetrahydrofuran is removed by reduced-pressure distillation, and the residue is baked at 120° C. for 3 hours to produce zinc oxide surface-treated with the silane coupling agent.

Then, 110 parts by weight of the silane coupling agent-treated zinc oxide and 500 parts by weight of tetrahydrofuran are stirred and mixed, and a solution prepared by dissolving 0.6 parts by weight of alizarin in 50 parts by weight of tetrahydrofuran is added to the resultant mixture and then stirred at 50° C. for 5 hours. Then, alizarin-added zinc oxide is filtered off by reduced-pressure filtration and further dried at 60° C. under reduced pressure, producing alizarin-added zinc oxide.

Then, 60 parts by weight of the alizarin-added zinc oxide, 13.5 parts by weight of a curing agent (blocked isocyanate, Sumidur 3175, manufactured by Sumitomo Bayer Urethane Co., Ltd.), 38 parts by weight of a mixture prepared by mixing 15 parts by weight of butyral resin (S-Lec BM-1, manufactured by Sekisui Chemical Co., Ltd.) in 85 parts by weight of methyl ether ketone, and 25 parts by weight of methyl ethyl ketone are mixed and dispersed for 2 hours by a sand mill using glass beads of 1 mm Ø, producing a dispersion.

Next, 0.005 parts by weight of dioctyltin dilaurate as a catalyst and 45 parts by weight of silicone resin particles (Tospearl 145, manufactured by Momentive Performance Materials Inc.) are added to the resultant dispersion, producing a coating solution for an undercoat layer.

The resultant coating solution for forming an undercoat layer is applied on each of the conductive supports by a dip coating method and then dried and cured at 180° C. or 30 minutes after wiping off the lower end inside surface, thereby forming an undercoat layer having a thickness of 25 μm.

(Formation of Charge Generation Layer)

There is prepared a mixture containing 15 parts by weight of hydroxygallium phthalocyanine as a charge generation material having diffraction peaks at least at Bragg angle positions (2θ±0.2°) of 7.3°, 16.0°, 24.9° and 28.0° in an X-ray diffraction spectrum using CuKα characteristic X-ray line, 10 parts by weight of vinyl chloride-vinyl acetate copolymer (VMCH, manufactured by NUC Corporation) as a binder resin, and 200 parts by weight of n-butyl acetate. The resultant mixture is dispersed for 4 hours by a sand mill using glass beads with a diameter of 1 mmØ. Then, 175 parts by weight of n-butyl acetate and 180 parts by weight of methyl ethyl ketone are added to the resultant dispersion and stirred to produce a coating solution for forming a charge generation layer.

The coating solution for forming a charge generation layer is applied on the undercoat layer by dip coating and then dried at 100° C. for 5 minutes to form a charge generation layer having a thickness of 0.20 μm.

(Formation of Charge Transport Layer)

Next, 12 parts by weight of a charge transport material represented by structural formula (CT1A) below, 28 parts by weight of a charge transport material represented by structural formula (CT2A) below, and 60 parts by weight of bisphenol Z polycarbonate resin (molecular weight: 40,000) are added and dissolved in 340 parts by weight of tetrahydrofuran to prepare a coating solution for forming a charge transport layer.

The coating solution for forming a charge transport layer is applied on the charge generation layer by dip coating and then dried at 150° C. for 40 minutes to form a charge transport layer having a thickness of 34 μm.

A photoreceptor of each of Examples 1 to 6 and Comparative Examples 1 and 2 is produced through the process described above.

<Evaluation>

—Evaluation of Striped Density Unevenness—

The resultant photoreceptor is mounted on an electrophotographic image forming apparatus (manufactured by Fuji Xerox Co., Ltd., DocuPrint CP500d), and an entire surface half-tone image (entire surface half-tone image of cyan color) with an image density of 50% is output on a sheet of A4-size paper.

The obtained image is read by a scanner ES10000 manufactured by EPSON Corporation, and a density difference at fixed periods is quantified. Specifically, a ΔL* value of density variation periodically appearing in the axial direction of the photoreceptor is determined. The results are shown in Table 1. The Δ* value exceeding 2.0 is determined as a level where striped density unevenness is confirmed by visual observation.

—Graininess Evaluation—

The resultant photoreceptor is mounted on an electrophotographic image forming apparatus (manufactured by Fuji Xerox Co., Ltd., DocuPrint CP500d), and an entire surface half-tone image (entire surface half-tone image of red color/green color/blue color) with an image density of 50% is output on a sheet of A4-size paper.

The obtained image is visually observed, and graininess is evaluated according to the following criteria. The results are shown in Table 1.

A: Good

B: Level without practical problem

C: Level with practical problem (CT1A)

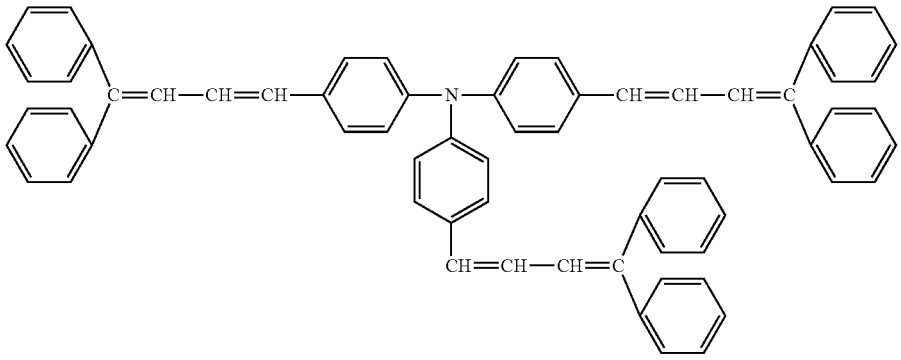

(CT2A)

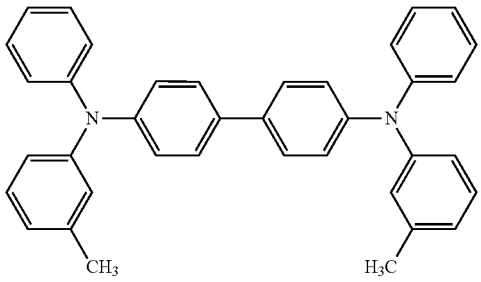

TABLE 1

| | Conductive support | | | | Photoreceptor | | Evaluation | |
|---|---|---|---|---|---|---|---|---|
| | Number | Wa (μm) | PPc | Pz (μm) | Number | Ra (μm) | Density unevenness | Graininess |
| Example 1 | (1) | 0.02 | 290 | 0.4 | (1) | 0.02 | 0.0 | A |
| Example 2 | (2) | 0.07 | 170 | 0.5 | (2) | 0.03 | 0.0 | A |
| Example 3 | (3) | 0.08 | 160 | 0.5 | (3) | 0.04 | 1.1 | A |
| Example 4 | (4) | 0.11 | 150 | 0.6 | (4) | 0.06 | 1.6 | A |
| Example 5 | (5) | 0.13 | 110 | 0.6 | (5) | 0.08 | 1.8 | A |
| Example 6 | (6) | 0.14 | 100 | 0.8 | (6) | 0.09 | 2.0 | B |
| Comparative Example 1 | (C1) | 0.16 | 95 | 1.5 | (C1) | 0.08 | 2.5 | C |
| Comparative Example 2 | (C2) | 0.35 | 65 | 2.0 | (C2) | 0.08 | 3.5 | C |

The results described above indicate that the examples exhibit the suppression of striped density unevenness periodically appearing in the axial direction of the photoreceptor and good graininess as compared the comparative examples.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A support for an electrophotographic photoreceptor, comprising:

a cylindrical cut pipe having a cut surface as an outer peripheral surface, wherein the outer peripheral surface has an arithmetic average waviness Wa of 0.15 μm or less in the axial direction and a peak count PPc of 100 or more and 990 or less in the axial direction.

2. The support for an electrophotographic photoreceptor according to claim 1, wherein the outer peripheral surface has an arithmetic average waviness Wa of 0.01 μm or more and 0.13 μm or less in the axial direction.

3. The support for an electrophotographic photoreceptor according to claim 1, wherein the outer peripheral surface has a maximum height Pz of 0.4 μm or more in the axial direction.

4. The support for an electrophotographic photoreceptor according to claim 3, wherein the outer peripheral surface has a maximum height Pz of 0.5 μm or more in the axial direction.

5. The support for an electrophotographic photoreceptor according to claim 1, wherein the outer peripheral surface has a peak count PPc of 130 or more and 960 or less in the axial direction.

6. The support for an electrophotographic photoreceptor according to claim 5, wherein the outer peripheral surface has a peak count PPc of 165 or more and 900 or less in the axial direction.

7. A support for an electrophotographic photoreceptor, comprising:

a cylindrical support having periodic waviness in an axial direction on an outer peripheral surface, wherein the outer peripheral surface has an arithmetic average waviness Wa of 0.15 μm or less in the axial direction and a peak count PPc of 100 or more and 990 or less in the axial direction.

8. The support for an electrophotographic photoreceptor according to claim 7, wherein the outer peripheral surface has an arithmetic average waviness Wa of 0.01 μm or more and 0.13 μm or less in the axial direction.

9. The support for an electrophotographic photoreceptor according to claim 7, wherein the outer peripheral surface has a maximum height Pz of 0.4 μm or more in the axial direction.

10. The support for an electrophotographic photoreceptor according to claim 7, wherein the outer peripheral surface has a maximum height Pz of 0.5 μm or more in the axial direction.

11. The support for an electrophotographic photoreceptor according to claim 7, wherein the outer peripheral surface has a peak count PPc of 130 or more and 960 or less in the axial direction.

12. The support for an electrophotographic photoreceptor according to claim 11, wherein the outer peripheral surface has a peak count PPc of 165 or more and 900 or less in the axial direction.

13. An electrophotographic photoreceptor comprising:

the support for an electrophotographic photoreceptor, according to a claim 1; and a photosensitive layer provided on the support for an electrophotographic photoreceptor.

14. The electrophotographic photoreceptor according to claim 13, wherein the outer peripheral surface has an arithmetic average roughness Ra of 0.08 μm or less in the axial direction.

15. An electrophotographic photoreceptor comprising:

the support for an electrophotographic photoreceptor according to a claim 7; and a photosensitive layer provided on the support for an electrophotographic photoreceptor.

16. The electrophotographic photoreceptor according to claim 15, wherein the outer peripheral surface has an arithmetic average roughness Ra of 0.08 μm or less in the axial direction.

17. A process cartridge comprising:

the electrophotographic photoreceptor according to claim 13, wherein the process cartridge is detachable from an image forming apparatus.

18. A process cartridge comprising:

the electrophotographic photoreceptor according to claim 15, wherein the process cartridge is detachable from an image forming apparatus.

19. An image forming apparatus comprising:

the electrophotographic photoreceptor according to claim 13;

a charging unit that charges the surface of the electrophotographic photoreceptor;

an electrostatic latent image forming unit that forms an electrostatic latent image on the charged surface of the electrophotographic photoreceptor;

a developing unit that forms a toner image by developing the electrostatic latent image formed on a surface of the electrophotographic photoreceptor with a developer containing a toner; and a transfer unit that transfers the toner image to the surface of a recording medium.

20. An image forming apparatus comprising:

the electrophotographic photoreceptor according to claim 15;

a charging unit that charges the surface of the electrophotographic photoreceptor;

an electrostatic latent image forming unit that forms an electrostatic latent image on the charged surface of the electrophotographic photoreceptor;

a developing unit that forms a toner image by developing the electrostatic latent image formed on a surface of the electrophotographic photoreceptor with a developer containing a toner; and a transfer unit that transfers the toner image to the surface of a recording medium.

* * * * *